US010077531B2

(12) United States Patent
Schroeder et al.

(10) Patent No.: US 10,077,531 B2
(45) Date of Patent: Sep. 18, 2018

(54) IMPROVING DRAINAGE OF PAPER PULP

(71) Applicant: NOVOZYMES A/S, Bagsvaerd (DK)

(72) Inventors: Brit Schroeder, Bagsvaerd (DK); Chee-Leong Soong, Franklinton, NC (US); Gregory Clark DeLozier, Franklinton, NC (US); Henrik Lund, Bagsvaerd (DK)

(73) Assignee: NOVOZYMES A/S, Bagsvaerd (DK)

( * ) Notice: Subject to any disclaimer, the term of this patent is extended or adjusted under 35 U.S.C. 154(b) by 0 days.

(21) Appl. No.: 14/649,839

(22) PCT Filed: Dec. 6, 2013

(86) PCT No.: PCT/EP2013/075803

§ 371 (c)(1),
(2) Date: Jun. 4, 2015

(87) PCT Pub. No.: WO2014/086976

PCT Pub. Date: Jun. 12, 2014

(65) Prior Publication Data

US 2015/0308047 A1 Oct. 29, 2015

Related U.S. Application Data

(60) Provisional application No. 61/736,068, filed on Dec. 12, 2012.

(30) Foreign Application Priority Data

Dec. 7, 2012 (EP) ..... 12196057

(51) Int. Cl.

| | |
|---|---|
| ***D21H 17/00*** | (2006.01) |
| ***D21H 27/10*** | (2006.01) |
| ***D21C 5/00*** | (2006.01) |
| ***D21H 11/16*** | (2006.01) |
| ***D21H 11/20*** | (2006.01) |
| ***D21H 17/22*** | (2006.01) |
| ***D21H 21/10*** | (2006.01) |
| ***D21H 11/14*** | (2006.01) |

(52) U.S. Cl.

CPC ..... *D21H 17/005* (2013.01); *D21C 5/005* (2013.01); *D21H 11/14* (2013.01); *D21H 11/16* (2013.01); *D21H 11/20* (2013.01); *D21H 17/22* (2013.01); *D21H 21/10* (2013.01); *D21H 27/10* (2013.01)

(58) Field of Classification Search

None

See application file for complete search history.

(56) References Cited

U.S. PATENT DOCUMENTS

| | | | |
|---|---|---|---|
| 2007/0196872 | A1 | 8/2007 | Bex |
| 2010/0124769 | A1 | 5/2010 | Brown |
| 2010/0281582 | A1 | 11/2010 | Brown |
| 2016/0017356 | A1 | 1/2016 | Bloksberg |

FOREIGN PATENT DOCUMENTS

| | | | |
|---|---|---|---|
| CN | 102296077 | A | 12/2011 |
| WO | 98/08940 | A1 | 3/1998 |
| WO | 2008/151043 | A1 | 12/2008 |
| WO | 2010/088387 | A1 | 8/2010 |
| WO | 2010/088463 | A2 | 8/2010 |
| WO | 2010/126772 | A1 | 11/2010 |
| WO | 2011/066449 | A1 | 6/2011 |
| WO | 2012/018691 | A2 | 2/2012 |
| WO | 2012/044836 | A1 | 4/2012 |
| WO | 2012/125937 | A2 | 9/2012 |

*Primary Examiner* — Mark Halpern

(74) *Attorney, Agent, or Firm* — Joshua Price

(57) ABSTRACT

The use of GH61 polypeptides in the treatment of pulp, for improving the freeness of the pulp, and/or for improving the short span compression strength of paper materials made from the pulp, such as paper, linerboard, corrugated paperboard, tissue, towels, corrugated containers and boxes.

14 Claims, No Drawings

Specification includes a Sequence Listing.

IMPROVING DRAINAGE OF PAPER PULP

CROSS-REFERENCE TO RELATED APPLICATIONS

This application is a 35 U.S.C. 371 national application of PCT/EP2013/075803 filed Dec. 6, 2013, which claims priority or the benefit under 35 U.S.C. 119 of European application no. 12196057.9 filed Dec. 7, 2012 and U.S. provisional application No. 61/736,068 filed Dec. 12, 2012, the contents of which are fully incorporated herein by reference.

REFERENCE TO A SEQUENCE LISTING

This application contains a Sequence Listing in computer readable form, which is incorporated herein by reference.

BACKGROUND OF THE INVENTION

Field of the Invention

The present invention relates to improving properties of paper or packaging pulp and/or paper or packaging materials made from the paper or packaging pulp, by treatment with glycoside hydrolase Family 61 polypeptides.

Description of the Related Art

It is well-known to use enzymes in the manufacture of paper and packaging materials. Examples of enzymes used for this purpose are proteases, lipases, xylanases, amylases, cellulases, as well as various oxidizing enzymes such as laccases and peroxidases.

The effects of these enzymes are wide-spread, e.g., control of various deposits such as pitch, strength-improvement, de-inking, drainage improvement, tissue softening, bleaching etc.

SUMMARY OF THE INVENTION

The present inventors surprisingly found that certain properties of pulp, such as the freeness, and/or properties of paper materials made from the pulp, such as short span compression strength, can be modified by treating or contacting the pulp with a glycoside hydrolase Family 61 (GH61) polypeptide during the paper or board making process.

DETAILED DESCRIPTION OF THE INVENTION

The current invention describes the application of GH61 polypeptides, alone or in concert with other enzymes, onto virgin or recycled pulp as a means to improve the freeness of paper, board or molded package-making furnishes (fiber, filler, water and functional additives) in order to reduce manufacturing costs, improve productivity and/or impart value within final products. Without being bound by theory, the mechanism appears to include enzymatic dissolution of colloidal substances and fibrils that tend to restrict the free drainage of water from the consolidating fibrous web (of the pulp) on the wire and the extraction of water from the consolidated fibrous web during pressing (e.g., within the press section). Moreover, the reduction of the fraction of such colloidal substances within the fibrous web will reduce the amount of bound water within the web thereby reducing the amount of steam necessary for drying the web within the dryer section.

When applied to and incubated with virgin and recycled pulp commonly used to manufacture paper or board, GH61 polypeptides significantly improve the standard "freeness" values of the resultant furnishes. A provisional correlation exists between freeness and paper/board machine drainage and/or dewatering. In light of the correlation, the pretreatment of the fibrous slurries with GH61 polypeptides, alone or in concert with one or more additional enzymes, most preferably selected from the glycosyl hydrolases, may improve the on-machine performance of the furnishes containing 1-100% of the enzymatically treated pulp. "On-machine" performance is a cumulative response dependent upon several factors including furnish type & composition, furnish drainage/dewatering rates & degrees, chemical additives (e.g., coagulants and polymeric retention & drainage aids), head box consistency, basis weight and machine design and operation. By directly impacting one or more of these factors, the current invention is assumed to improve the overall "on-machine" performance of furnishes containing GH61 polypeptides conditioned pulp.

The present invention thus imparts several advantages, which include:

a) a novel enzymatic means to improve on-machine performance of virgin and recovered pulp in the absence of glycosyl hydrolases.

b) a means to extend the on-machine benefits of certain traditional enzymatic applications beyond levels and degrees obtainable through application of the traditional enzymatic applications alone.

Accordingly, the invention relates to the use of GH61 polypeptides in the treatment of pulp, for improving the freeness of the pulp, and/or for improving the short span compression strength of the paper, board or packaging materials made from the pulp, such as paper, linerboard, corrugated paperboard, tissue, towels, molded packaging, corrugated containers and boxes.

Paper and Pulp

The term "paper and packaging material" refers to products, which can be made out of pulp, such as paper, linerboard, corrugated paperboard, tissue, towels, packaging materials, corrugated containers or boxes.

The term "pulp" means any pulp which can be used for the production of a paper and packaging material. Pulp is a lignocellulosic fibrous material prepared by chemically or mechanically separating cellulose fibres from wood, fibre crops or waste paper. For example, the pulp can be supplied as a virgin pulp, or can be derived from a recycled source. The pulp may be a wood pulp, a non-wood pulp or a pulp made from waste paper. A wood pulp may be made from softwood such as pine, redwood, fir, spruce, cedar and hemlock or from hardwood such as maple, alder, birch, hickory, beech, aspen, acacia and eucalyptus. A non-wood pulp may be made, e.g., from flax, hemp, bagasse, bamboo, cotton or kenaf. A waste paper pulp may be made by re-pulping waste paper such as newspaper, mixed office waste, computer print-out, white ledger, magazines, milk cartons, paper cups etc.

In a particular embodiment, the pulp to be treated comprises both hardwood pulp and softwood pulp.

The wood pulp to be treated may be mechanical pulp (such as ground wood pulp, GP), chemical pulp (such as Kraft pulp or sulfite pulp), semichemical pulp (SCP), thermomechanical pulp (TMP), chemithermomechanical pulp (CTMP), or bleached chemithermomechanical pulp (BCTMP).

Mechanical pulp is manufactured by the grinding and refining methods, wherein the raw material is subjected to periodical pressure impulses. TMP is thermomechanical pulp, GW is groundwood pulp, PGW is pressurized groundwood pulp, RMP is refiner mechanical pulp, PRMP is pressurized refiner mechanical pulp and CTMP is chemithermimechanical pulp.

Chemical pulp is manufactured by alkaline cooking whereby most of the lignin and hemicellulose components are removed. In Kraft pulping or sulphate cooking sodium sulphide or sodium hydroxide are used as principal cooking chemicals.

The Kraft pulp to be treated may be a bleached Kraft pulp, which may consist of softwood bleached Kraft (SWBK, also called NBKP (Nadel Holz Bleached Kraft Pulp)), hardwood bleached Kraft (HWBK, also called LBKP (Laub Holz Bleached Kraft Pulp and)) or a mixture of these.

The pulp to be used in the process of the invention is a suspension of mechanical or chemical pulp or a combination thereof. For example, the pulp to be used in the process of the invention may comprise 0%, 10-20%, 20-30%, 30-40%, 40-50%, 50-60%, 60-70%, 70-80%, 80-90%, or 90-100% of chemical pulp. In a particular embodiment, a chemical pulp forms part of the pulp being used for manufacturing the paper material. In the present context, the expression "forms part of" means that in the pulp to be used in the process of the invention, the percentage of chemical pulp lies within the range of 1-99%. In particular embodiments, the percentage of chemical pulp lies within the range of 2-98%, 3-97%, 4-96%, 5-95%, 6-94%, 7-93%, 8-92%, 9-91%, 10-90%, 15-85%, 20-80%, 25-75%, 30-70%, 40-60%, or 45-55%.

In a particular embodiment of the use and the process of the invention, the chemical pulp is a Kraft pulp, a sulfite pulp, a semichemical pulp (SCP), a thermomechanical pulp (TMP), a chemithermomechanical pulp (CTMP), a bleached chemithermomechanical pulp (BCTMP). In particular embodiments the Kraft pulp is bleached Kraft pulp, for example softwood bleached Kraft (SWBK, also called NBKP (Nadel Holz Bleached Kraft Pulp)), hardwood bleached Kraft (HWBK, also called LBKP (Laub Holz Bleached Kraft Pulp and)) or a mixture thereof.

Freeness

The freeness of pulp is designed to give a measure of the rate at which a dilute suspension of pulp (e.g., 3 g of pulp in 1 L of water) drains within standardized testing equipment. The freeness, or drainage rate (see e.g., TAPPI test method T 221 "Drainage Time of Pulp"), has been shown to be related to the surface conditions and swelling of the fibers. Besides these factors, the result is dependent also on conditions under which the test is carried out, such as stock preparation, temperature, and water quality.

In many cases there is a correlation between freeness values and either (a) a target level of refining of pulp, or (b) the ease of drainage of white water from the wet web, especially in the early sections of a Fourdrinier former. Standard tests of freeness are based on gravity dewatering through a screen. The devices are designed so that an operator can judge the speed of dewatering by observing the volume of liquid collected in a graduated cylinder. Freeness tends to be decreased by refining and by increases in the level of fines in the furnish. Freeness can be increased by use of drainage aids, removal of fines, or enzymatic treatments to convert mucilaginous materials into sugars.

Freeness, as defined in the methods, compositions and uses of the present invention, is measured as Canadian Standard Freeness, which is reflected in TAPPI test method T 227 "Freeness of pulp (Canadian standard method)", as published by the Technical Association of the Pulp and Paper Industry (TAPPI).

Compression Strength

Compression strength, as defined in the methods, compositions and uses of the present invention, is measured according to TAPPI test method T 826 "Short span compressive strength of containerboard".

Short span compressive strength index is the recommended measure of Short span compressive strength for comparing papers of differing grammages. Short span compressive strength index is obtained by dividing the Short span compressive strength measured in units of newtons per meter (N/m) by the grammage of the paper in units of grams per square meter ($g/m^2$).

GH61 Polypeptides

The term "GH61 polypeptide" means a polypeptide falling into the glycoside hydrolase Family 61 according to Henrissat, 1991, A classification of glycosyl hydrolases based on amino-acid sequence similarities, *Biochem. J.* 280: 309-316, and Henrissat and Bairoch, 1996, Updating the sequence-based classification of glycosyl hydrolases, *Biochem. J.* 316: 695-696.

In the compositions and methods of the present invention, any GH61 polypeptide can be used.

In a first aspect, the GH61 polypeptide comprises the following motifs:

[ILMV]-P-x(4,5)-G-x-Y-[ILMV]-x-R-x-[EQ]-x(4)-[HNQ] and [FW]-[TF]-K-[AIV], wherein x is any amino acid, x(4,5) is any four or five contiguous amino acids, and x(4) is any four contiguous amino acids.

The GH61 polypeptide comprising the above-noted motifs may further comprise:

H-x(1,2)-G-P-x(3)-[YW]-[AILMV],

[EQ]-x-Y-x(2)-C-x-[EHQN]-[FILV]-x-[ILV], or

H-x(1,2)-G-P-x(3)-[YW]-[AILMV] and [EQ]-x-Y-x(2)-C-x-[EHQN]-[FILV]-x-[ILV], wherein x is any amino acid, x(1,2) is any one or two contiguous amino acids, x(3) is any three contiguous amino acids, and x(2) is any two contiguous amino acids.

In a preferred aspect, the GH61 polypeptide further comprises H-x(1,2)-G-P-x(3)-[YW]-[AILMV]. In another preferred aspect, the GH61 polypeptide further comprises [EQ]-x-Y-x(2)-C-x-[EHQN]-[FILV]-x-[ILV]. In another preferred aspect, the GH61 polypeptide further comprises H-x(1,2)-G-P-x(3)-[YW]-[AILMV] and [EQ]-x-Y-x(2)-C-x-[EHQN]-[FILV]-x-[ILV].

In a second aspect, the GH61 polypeptide comprises the following motif:

[ILMV]-P-x(4,5)-G-x-Y-[ILMV]-x-R-x-[EQ]-x(3)-A-[HNQ], wherein x is any amino acid, x(4,5) is any 4 or 5 contiguous amino acids, and x(3) is any 3 contiguous amino acids. In the above motif, the accepted IUPAC single letter amino acid abbreviation is employed.

In a third aspect, the GH61 polypeptide comprises an amino acid sequence that has a sequence identity to the mature polypeptide of SEQ ID NO: 1 (*Acremonium alcalophilum*), SEQ ID NO: 2 (*Acremonium alcalophilum*), SEQ ID NO: 3 (*Acremonium alcalophilum*), SEQ ID NO: 4 (*Thielavia terrestris*), SEQ ID NO: 5 (*Thielavia terrestris*), SEQ ID NO: 6 (*Thielavia terrestris*), SEQ ID NO: 7 (*Thielavia terrestris*), SEQ ID NO: 8 (*Thielavia terrestris*), SEQ ID NO: 9 (*Thielavia terrestris*), SEQ ID NO: 10 (*Thermoascus aurantiacus*), SEQ ID NO: 11 (*Trichoderma reesei*), SEQ ID NO: 12 (*Myceliophthora thermophila*), SEQ ID NO: 13 (*Myceliophthora thermophila*), SEQ ID NO: 14 (*Myceliophthora thermophila*), SEQ ID NO: 15 (*Myceliophthora thermophila*), SEQ ID NO: 16 (*Mycelio-*

*phthora thermophila*), SEQ ID NO: 17 (*Thermoascus aurantiacus*), SEQ ID NO: 18 (*Aspergillus fumigatus*), SEQ ID NO: 19 (*Penicillium pinophilum*), SEQ ID NO: 20 (*Thermoascus* sp.), SEQ ID NO: 21 (*Penicillium* sp.), SEQ ID NO: 22 (*Thielavia terrestris*), SEQ ID NO: 23 (*Thielavia terrestris*), SEQ ID NO: 24 (*Thielavia terrestris*), SEQ ID NO: 25 (*Thielavia terrestris*), SEQ ID NO: 26 (*Thielavia terrestris*), SEQ ID NO: 27 (*Thielavia terrestris*), SEQ ID NO: 28 (*Thielavia terrestris*), SEQ ID NO: 29 (*Thielavia terrestris*), SEQ ID NO: 30 (*Thielavia terrestris*), SEQ ID NO: 31 (*Thielavia terrestris*), SEQ ID NO: 32 (*Thielavia terrestris*), SEQ ID NO: 33 (*Thermoascus crustaceus*), SEQ ID NO: 34 (*Thermoascus crustaceus*), or SEQ ID NO: 35 (*Thermoascus crustaceus*) of at least 50%, e.g., at least 55%, at least 60%, at least 65%, at least 70%, at least 75%, at least 80%, at least 85%, at least 90%, at least 91%, at least 92%, at least 93%, at least 94%, or at least 95%, at least 96%, at least 97%, at least 98%, at least 99%, or at least 100%.

Sequence Identity:

The relatedness between two amino acid sequences or between two nucleotide sequences is described by the parameter "sequence identity".

For purposes of the present invention, the sequence identity between two amino acid sequences is determined using the Needleman-Wunsch algorithm (Needleman and Wunsch, 1970, *J. Mol. Biol.* 48: 443-453) as implemented in the Needle program of the EMBOSS package (EMBOSS: The European Molecular Biology Open Software Suite, Rice et al., 2000, *Trends Genet.* 16: 276-277), preferably version 5.0.0 or later. The parameters used are gap open penalty of 10, gap extension penalty of 0.5, and the EBLOSUM62 (EMBOSS version of BLOSUM62) substitution matrix. The output of Needle labeled "longest identity" (obtained using the -nobrief option) is used as the percent identity and is calculated as follows:

(Identical Residues×100)/(Length of Alignment−Total Number of Gaps in Alignment)

For purposes of the present invention, the sequence identity between two deoxyribonucleotide sequences is determined using the Needleman-Wunsch algorithm (Needleman and Wunsch, 1970, supra) as implemented in the Needle program of the EMBOSS package (EMBOSS: The European Molecular Biology Open Software Suite, Rice et al., 2000, supra), preferably version 5.0.0 or later. The parameters used are gap open penalty of 10, gap extension penalty of 0.5, and the EDNAFULL (EMBOSS version of NCBI NUC4.4) substitution matrix. The output of Needle labeled "longest identity" (obtained using the -nobrief option) is used as the percent identity and is calculated as follows:

(Identical Deoxyribonucleotides×100)/(Length of Alignment−Total Number of Gaps in Alignment)

In a sixth aspect, the GH61 polypeptide is an artificial variant comprising a substitution, deletion, and/or insertion of one or more (or several) amino acids of the mature polypeptide of SEQ ID NO: 1, SEQ ID NO: 2, SEQ ID NO: 3, SEQ ID NO: 4, SEQ ID NO: 5, SEQ ID NO: 6, SEQ ID NO: 7, SEQ ID NO: 8, SEQ ID NO: 9, SEQ ID NO: 10, SEQ ID NO: 11, SEQ ID NO: 12, SEQ ID NO: 13, SEQ ID NO: 14, SEQ ID NO: 15, SEQ ID NO: 16, SEQ ID NO: 17, SEQ ID NO: 18, SEQ ID NO: 19, SEQ ID NO: 20, SEQ ID NO: 21, SEQ ID NO: 22, SEQ ID NO: 23, SEQ ID NO: 24, SEQ ID NO: 25, SEQ ID NO: 26, SEQ ID NO: 27, SEQ ID NO: 28, SEQ ID NO: 29, SEQ ID NO: 30, SEQ ID NO: 31, SEQ ID NO: 32, SEQ ID NO: 33, SEQ ID NO: 34, or SEQ ID NO: 35; or a homologous sequence thereof.

Preferably, amino acid changes are of a minor nature, that is conservative amino acid substitutions or insertions that do not significantly affect the folding and/or activity of the protein; small deletions, typically of one to about 30 amino acids; small amino- or carboxyl-terminal extensions, such as an amino-terminal methionine residue; a small linker peptide of up to about 20-25 residues; or a small extension that facilitates purification by changing net charge or another function, such as a poly-histidine tract, an antigenic epitope or a binding domain.

Examples of conservative substitutions are within the group of basic amino acids (arginine, lysine and histidine), acidic amino acids (glutamic acid and aspartic acid), polar amino acids (glutamine and asparagine), hydrophobic amino acids (leucine, isoleucine and valine), aromatic amino acids (phenylalanine, tryptophan and tyrosine), and small amino acids (glycine, alanine, serine, threonine and methionine). Amino acid substitutions that do not generally alter specific activity are known in the art and are described, for example, by H. Neurath and R. L. Hill, 1979, In, *The Proteins*, Academic Press, New York. The most commonly occurring exchanges are Ala/Ser, Val/Ile, Asp/Glu, Thr/Ser, Ala/Gly, Ala/Thr, Ser/Asn, Ala/Val, Ser/Gly, Tyr/Phe, Ala/Pro, Lys/Arg, Asp/Asn, Leu/Ile, Leu/Val, Ala/Glu, and Asp/Gly.

Alternatively, the amino acid changes are of such a nature that the physico-chemical properties of the polypeptides are altered. For example, amino acid changes may improve the thermal stability of the polypeptide, alter the substrate specificity, change the pH optimum, and the like.

Essential amino acids in a parent polypeptide can be identified according to procedures known in the art, such as site-directed mutagenesis or alanine-scanning mutagenesis (Cunningham and Wells, 1989, *Science* 244: 1081-1085). In the latter technique, single alanine mutations are introduced at every residue in the molecule, and the resultant mutant molecules are tested for cellulolytic enhancing activity to identify amino acid residues that are critical to the activity of the molecule. See also, Hilton et al., 1996, *J. Biol. Chem.* 271: 4699-4708. The active site of the enzyme or other biological interaction can also be determined by physical analysis of structure, as determined by such techniques as nuclear magnetic resonance, crystallography, electron diffraction, or photoaffinity labeling, in conjunction with mutation of putative contact site amino acids. See, for example, de Vos et al., 1992, *Science* 255: 306-312; Smith et al., 1992, *J. Mol. Biol.* 224: 899-904; Wlodaver et al., 1992, *FEBS Lett.* 309: 59-64. The identities of essential amino acids can also be inferred from analysis of identities with polypeptides that are related to the parent polypeptide.

Single or multiple amino acid substitutions, deletions, and/or insertions can be made and tested using known methods of mutagenesis, recombination, and/or shuffling, followed by a relevant screening procedure, such as those disclosed by Reidhaar-Olson and Sauer, 1988, *Science* 241: 53-57; Bowie and Sauer, 1989, *Proc. Natl. Acad. Sci. USA* 86: 2152-2156; WO 95/17413; or WO 95/22625. Other methods that can be used include error-prone PCR, phage display (e.g., Lowman et al., 1991, *Biochemistry* 30: 10832-10837; U.S. Pat. No. 5,223,409; WO 92/06204), and region-directed mutagenesis (Derbyshire et al., 1986, *Gene* 46: 145; Ner et al., 1988, *DNA* 7: 127).

Mutagenesis/shuffling methods can be combined with high-throughput, automated screening methods to detect activity of cloned, mutagenized polypeptides expressed by host cells (Ness et al., 1999, *Nature Biotechnology* 17: 893-896). Mutagenized DNA molecules that encode active polypeptides can be recovered from the host cells and rapidly sequenced using standard methods in the art. These methods allow the rapid determination of the importance of individual amino acid residues in a polypeptide.

The total number of amino acid substitutions, deletions and/or insertions of the mature GH61 polypeptide of SEQ ID NO: 1, SEQ ID NO: 2, SEQ ID NO: 3, SEQ ID NO: 4, SEQ ID NO: 5, SEQ ID NO: 6, SEQ ID NO: 7, SEQ ID NO: 8, SEQ ID NO: 9, SEQ ID NO: 10, SEQ ID NO: 11, SEQ ID NO: 12, SEQ ID NO: 13, SEQ ID NO: 14, SEQ ID NO: 15, SEQ ID NO: 16, SEQ ID NO: 17, SEQ ID NO: 18, SEQ ID NO: 19, SEQ ID NO: 20, SEQ ID NO: 21, SEQ ID NO: 22, SEQ ID NO: 23, SEQ ID NO: 24, SEQ ID NO: 25, SEQ ID NO: 26, SEQ ID NO: 27, SEQ ID NO: 28, SEQ ID NO: 29, SEQ ID NO: 30, SEQ ID NO: 31, SEQ ID NO: 32, SEQ ID NO: 33, SEQ ID NO: 34, or SEQ ID NO: 35 is not more than 4, e.g., 1, 2, 3, or 4.

In another aspect, the GH61 polypeptide is used in the presence of a soluble activating divalent metal cation as described in WO 2008/151043, e.g., manganese ions or copper ions.

In one aspect, the GH61 polypeptide is used in the presence of a dioxy compound, a bicylic compound, a heterocyclic compound, a nitrogen-containing compound, a quinone compound, or a sulfur-containing compound.

The dioxy compound may include any suitable compound containing two or more oxygen atoms. In some aspects, the dioxy compounds contain a substituted aryl moiety as described herein. The dioxy compounds may comprise one or more (several) hydroxyl and/or hydroxyl derivatives, but also include substituted aryl moieties lacking hydroxyl and hydroxyl derivatives. Non-limiting examples of dioxy compounds include pyrocatechol or catechol; caffeic acid; 3,4-dihydroxybenzoic acid; 4-tert-butyl-5-methoxy-1,2-benzenediol; pyrogallol; gallic acid; methyl-3,4,5-trihydroxybenzoate; 2,3,4-trihydroxybenzophenone; 2,6-dimethoxyphenol; sinapinic acid; 3,5-dihydroxybenzoic acid; 4-chloro-1,2-benzenediol; 4-nitro-1,2-benzenediol; tannic acid; ethyl gallate; methyl glycolate; dihydroxyfumaric acid; 2-butyne-1,4-diol; (croconic acid; 1,3-propanediol; tartaric acid; 2,4-pentanediol; 3-ethyoxy-1,2-propanediol; 2,4,4'-trihydroxybenzophenone; cis-2-butene-1,4-diol; 3,4-dihydroxy-3-cyclobutene-1,2-dione; dihydroxyacetone; acrolein acetal; methyl-4-hydroxybenzoate; 4-hydroxybenzoic acid; and methyl-3,5-dimethoxy-4-hydroxybenzoate; or a salt or solvate thereof.

The bicyclic compound may include any suitable substituted fused ring system as described herein. The compounds may comprise one or more (several) additional rings, and are not limited to a specific number of rings unless otherwise stated. In one aspect, the bicyclic compound is a flavonoid. In another aspect, the bicyclic compound is an optionally substituted isoflavonoid. In another aspect, the bicyclic compound is an optionally substituted flavylium ion, such as an optionally substituted anthocyanidin or optionally substituted anthocyanin, or derivative thereof. Non-limiting examples of bicyclic compounds include epicatechin; quercetin; myricetin; taxifolin; kaempferol; morin; acacetin; naringenin; isorhamnetin; apigenin; cyanidin; cyanin; kuromanin; (keracyanin; or a salt or solvate thereof.

The heterocyclic compound may be any suitable compound, such as an optionally substituted aromatic or non-aromatic ring comprising a heteroatom, as described herein. In one aspect, the heterocyclic is a compound comprising an optionally substituted heterocycloalkyl moiety or an optionally substituted heteroaryl moiety. In another aspect, the optionally substituted heterocycloalkyl moiety or optionally substituted heteroaryl moiety is an optionally substituted 5-membered heterocycloalkyl or an optionally substituted 5-membered heteroaryl moiety. In another aspect, the optionally substituted heterocycloalkyl or optionally substituted heteroaryl moiety is an optionally substituted moiety selected from pyrazolyl, furanyl, imidazolyl, isoxazolyl, oxadiazolyl, oxazolyl, pyrrolyl, pyridyl, pyrimidyl, pyridazinyl, thiazolyl, triazolyl, thienyl, dihydrothienopyrazolyl, thianaphthenyl, carbazolyl, benzimidazolyl, benzothienyl, benzofuranyl, indolyl, quinolinyl, benzotriazolyl, benzothiazolyl, benzooxazolyl, benzimidazolyl, isoquinolinyl, isoindolyl, acridinyl, benzoisazolyl, dimethylhydantoin, pyrazinyl, tetrahydrofuranyl, pyrrolinyl, pyrrolidinyl, morpholinyl, indolyl, diazepinyl, azepinyl, thiepinyl, piperidinyl, and oxepinyl. In another aspect, the optionally substituted heterocycloalkyl moiety or optionally substituted heteroaryl moiety is an optionally substituted furanyl. Non-limiting examples of heterocyclic compounds include (1,2-dihydroxyethyl)-3,4-dihydroxyfuran-2(5H)-one; 4-hydroxy-5-methyl-3-furanone; 5-hydroxy-2(5H)-furanone; [1,2-dihydroxyethyl]furan-2,3,4(5H)-trione; α-hydroxy-γ-butyrolactone; ribonic δ-lactone; aldohexuronicaldohexuronic acid γ-lactone; gluconic acid δ-lactone; 4-hydroxycoumarin; dihydrobenzofuran; 5-(hydroxymethyl) furfural; furoin; 2(5H)-furanone; 5,6-dihydro-2H-pyran-2-one; and 5,6-dihydro-4-hydroxy-6-methyl-2H-pyran-2-one; or a salt or solvate thereof.

The nitrogen-containing compound may be any suitable compound with one or more nitrogen atoms. In one aspect, the nitrogen-containing compound comprises an amine, imine, hydroxylamine, or nitroxide moiety. Non-limiting examples of nitrogen-containing compounds include acetone oxime; violuric acid; pyridine-2-aldoxime; 2-aminophenol; 1,2-benzenediamine; 2,2,6,6-tetramethyl-1-piperidinyloxy; 5,6,7,8-tetrahydrobiopterin; 6,7-dimethyl-5,6,7,8-tetrahydropterine; and maleamic acid; or a salt or solvate thereof.

The quinone compound may be any suitable compound comprising a quinone moiety as described herein. Non-limiting examples of quinone compounds include 1,4-benzoquinone; 1,4-naphthoquinone; 2-hydroxy-1,4-naphthoquinone; 2,3-dimethoxy-5-methyl-1,4-benzoquinone or coenzyme $Q_0$; 2,3,5,6-tetramethyl-1,4-benzoquinone or duroquinone; 1,4-dihydroxyanthraquinone; 3-hydroxy-1-methyl-5,6-indolinedione or adrenochrome; 4-tert-butyl-5-methoxy-1,2-benzoquinone; pyrroloquinoline quinone; or a salt or solvate thereof.

The sulfur-containing compound may be any suitable compound comprising one or more sulfur atoms. In one aspect, the sulfur-containing comprises a moiety selected from thionyl, thioether, sulfinyl, sulfonyl, sulfamide, sulfonamide, sulfonic acid, and sulfonic ester. Non-limiting examples of sulfur-containing compounds include ethanethiol; 2-propanethiol; 2-propene-1-thiol; 2-mercaptoethanesulfonic acid; benzenethiol; benzene-1,2-dithiol; cysteine; methionine; glutathione; cystine; or a salt or solvate thereof.

In an embodiment, the GH61 polypeptide is present in the amount of 2-1000 micrograms/g dry solids (DS), e.g., 5-100, 10-40, or 20-40 micrograms/g DS.

Compositions, Methods and Uses

In a first aspect, the present invention provides a method for increasing (improving) the freeness of a pulp, and/or increasing the short span compression strength of a paper or packaging material made from the pulp, comprising treating the pulp with a GH61 polypeptide.

Optionally, a paper or packaging material is subsequently made from the treated pulp.

In an embodiment, the short span compression strength is measured according to TAPPI test method T 826, and the freeness is measured according to TAPPI test method T 227.

The method of the invention conveys improved properties of the paper or packaging material. The improved properties of the paper or packaging material are improved as compared to a paper or packaging material, which is made without contacting the pulp with a GH61 polypeptide. The treated pulp may also exhibit improved drainage/dewatering.

In an embodiment, the amino acid sequence of the GH61 polypeptide comprises the motif(s):

[ILMV]-P-x(4,5)-G-x-Y-[ILMV]-x-R-x-[EQ]-x(4)-[HNQ] and/or

[FW]-[TF]-K-[AIV] and/or

H-x(1,2)-G-P-x(3)-[YW]-[AILMV] and/or

[EQ]-x-Y-x(2)-C-x-[EHQN]-[FILV]-x-[ILV].

In another embodiment, the amino acid sequence of the GH61 polypeptide comprises or consists of an amino acid sequence that has at least 50% sequence identity to the mature polypeptide of SEQ ID NO: 1, SEQ ID NO: 2, or SEQ ID NO: 3; preferably at least 55% sequence identity, more preferably at least 60% sequence identity, more preferably at least 65% sequence identity, more preferably at least 70% sequence identity, more preferably at least 75% sequence identity, more preferably at least 80% sequence identity, more preferably at least 85% sequence identity, more preferably at least 90% sequence identity, and most preferably at least 95% sequence identity to the mature polypeptide of SEQ ID NO: 1, SEQ ID NO: 2, or SEQ ID NO: 3.

In another embodiment, the amino acid sequence of the GH61 polypeptide comprises or consists of an amino acid sequence that has up to 10, up to 9, up to 8, up to 7, up to 6, up to 5, up to 4, up to 3, up to 2, or up to 1 substitution(s) as compared to the mature polypeptide of SEQ ID NO: 1, SEQ ID NO: 2, or SEQ ID NO: 3.

In another embodiment, the amino acid sequence of the GH61 polypeptide comprises or consists of the mature polypeptide of SEQ ID NO: 1, SEQ ID NO: 2, and/or SEQ ID NO: 3.

In another embodiment, the amino acid sequence of the GH61 polypeptide comprises or consists of the mature polypeptide of SEQ ID NO: 1, SEQ ID NO: 2, SEQ ID NO: 3, SEQ ID NO: 4, SEQ ID NO: 5, SEQ ID NO: 6, SEQ ID NO: 7, SEQ ID NO: 8, SEQ ID NO: 9, SEQ ID NO: 10, SEQ ID NO: 11, SEQ ID NO: 12, SEQ ID NO: 13, SEQ ID NO: 14, SEQ ID NO: 15, SEQ ID NO: 16, SEQ ID NO: 17, SEQ ID NO: 18, SEQ ID NO: 19, SEQ ID NO: 20, SEQ ID NO: 21, SEQ ID NO: 22, SEQ ID NO: 23, SEQ ID NO: 24, SEQ ID NO: 25, SEQ ID NO: 26, SEQ ID NO: 27, SEQ ID NO: 28, SEQ ID NO: 29, SEQ ID NO: 30, SEQ ID NO: 31, SEQ ID NO: 32, SEQ ID NO: 33, SEQ ID NO: 34, or SEQ ID NO: 35; or a homologous sequence thereof.

In another embodiment, the GH61 polypeptide is used in the presence of manganese sulphate (or manganese ions), copper sulphate (or copper ions) and/or ascorbic acid. Other suitable compounds, such as pyrogallol (1,2,3-trihydroxybenzene), which may be used with the GH61 polypeptide, are mentioned above.

In another embodiment, the pulp is also treated (or contacted) with an endoglucanase, such as the endoglucanase of SEQ ID NO: 36.

In another embodiment, the paper or packaging material is paper, linerboard, corrugated paperboard, tissue, towels, molded packaging materials, or corrugated containers or boxes.

In another embodiment, the pulp is a recovered, recycled or secondary pulp.

In another embodiment, the pulp is a chemical pulp. Preferably, the pulp is Kraft pulp or sulphite pulp. The pulp may be a wood pulp, such as a hardwood pulp (for example eucalyptus pulp) or softwood pulp (for example pine pulp).

The present invention also provides a paper or packaging material made from a pulp, wherein the pulp has been subjected to the methods of the invention.

In a second aspect, the present invention provides a composition for making paper or packaging materials, comprising a pulp and a GH61 polypeptide. The pulp and the GH61 polypeptide are the same components as described in the methods of the invention.

In an embodiment, the amino acid sequence of the GH61 polypeptide comprises the motif(s):

[ILMV]-P-x(4,5)-G-x-Y-[ILMV]-x-R-x-[EQ]-x(4)-[HNQ] and/or

[FW]-[TF]-K-[AIV] and/or

H-x(1,2)-G-P-x(3)-[YW]-[AILMV] and/or

[EQ]-x-Y-x(2)-C-x-[EHQN]-[FILV]-x-[ILV].

In another embodiment, the amino acid sequence of the GH61 polypeptide comprises or consists of an amino acid sequence that has at least 50% sequence identity to the mature polypeptide of SEQ ID NO: 1, SEQ ID NO: 2, or SEQ ID NO: 3; preferably at least 55% sequence identity, more preferably at least 60% sequence identity, more preferably at least 65% sequence identity, more preferably at least 70% sequence identity, more preferably at least 75% sequence identity, more preferably at least 80% sequence identity, more preferably at least 85% sequence identity, more preferably at least 90% sequence identity, and most preferably at least 95% sequence identity to the mature polypeptide of SEQ ID NO: 1, SEQ ID NO: 2, or SEQ ID NO: 3.

In another embodiment, the amino acid sequence of the GH61 polypeptide comprises or consists of an amino acid sequence that has up to 10, up to 9, up to 8, up to 7, up to 6, up to 5, up to 4, up to 3, up to 2, or up to 1 substitution(s) as compared to the mature polypeptide of SEQ ID NO: 1, SEQ ID NO: 2, or SEQ ID NO: 3.

In another embodiment, the amino acid sequence of the GH61 polypeptide comprises or consists of the mature polypeptide of SEQ ID NO: 1, SEQ ID NO: 2, or SEQ ID NO: 3.

In another embodiment, the amino acid sequence of the GH61 polypeptide comprises or consists of the mature polypeptide of SEQ ID NO: 1, SEQ ID NO: 2, SEQ ID NO: 3, SEQ ID NO: 4, SEQ ID NO: 5, SEQ ID NO: 6, SEQ ID NO: 7, SEQ ID NO: 8, SEQ ID NO: 9, SEQ ID NO: 10, SEQ ID NO: 11, SEQ ID NO: 12, SEQ ID NO: 13, SEQ ID NO: 14, SEQ ID NO: 15, SEQ ID NO: 16, SEQ ID NO: 17, SEQ ID NO: 18, SEQ ID NO: 19, SEQ ID NO: 20, SEQ ID NO: 21, SEQ ID NO: 22, SEQ ID NO: 23, SEQ ID NO: 24, SEQ ID NO: 25, SEQ ID NO: 26, SEQ ID NO: 27, SEQ ID NO: 28, SEQ ID NO: 29, SEQ ID NO: 30, SEQ ID NO: 31, SEQ ID NO: 32, SEQ ID NO: 33, SEQ ID NO: 34, or SEQ ID NO: 35; or a homologous sequence thereof.

In another embodiment, the composition includes manganese sulphate, copper sulphate and/or ascorbic acid. Other suitable compounds, such as pyrogallol (1,2,3-trihydroxybenzene), which may be included in the composition and used with the GH61 polypeptide, are mentioned above.

In another embodiment, the composition includes an endoglucanase, such as the endoglucanase of SEQ ID NO: 36, or an endoglucanase having an amino acid sequence which is at least 70%, at least 75%, at least 80%, at least 85%, at least 90%, or at least 95% identical to the amino acid sequence of SEQ ID NO: 36. In an embodiment, the number of amino acid changes (substitutions) introduced into the endoglucanase of SEQ ID NO: 36 is not more than 10, e.g., 1, 2, 3, 4, 5, 6, 7, 8 or 9. The amino acid changes may be of a minor nature, that is conservative amino acid substitutions or insertions that do not significantly affect the folding and/or activity of the protein.

In another embodiment, the paper or packaging material is paper, linerboard, corrugated paperboard, tissue, towels, molded packaging materials, or corrugated containers or boxes.

In another embodiment, the pulp is a recovered, recycled or secondary pulp.

In another embodiment, the pulp is a chemical pulp. Preferably, the pulp is Kraft pulp or sulphite pulp. The pulp may be a wood pulp, such as a hardwood pulp (for example eucalyptus pulp) or softwood pulp (for example pine pulp).

In another embodiment, the composition is an aqueous composition with a pH of about 4 to about 8, preferably the composition has a pH of about 5 to about 7.

The composition of the second aspect may be used for making a paper or packaging material with increased short span compression strength, as compared to a paper or packaging material made from the composition without a GH61 polypeptide.

Process Conditions

The process of the invention is particularly applicable to the improvement of certain properties, such as improvement of the freeness of a pulp, or improvement of short span compression strength of paper or packaging materials made from the pulp.

In the case of paper or packaging, and pulp processing, the process according to the invention can be carried out at any pulp production stage. The GH61 polypeptide can be added to any holding tank, e.g., to a pulp storing container (storage chest), storage tower, mixing chest or metering chest. The GH61 polypeptide treatment can be performed before the bleaching of pulp, in connection with the pulp bleaching process or after the bleaching. The GH61 polypeptide can also be added to the circulated process water (white water) originating from bleaching and process water (brown water) originating from the mechanical or chemimechanical pulping process.

In the present context, the term "process water" comprises i.a. 1) water added as a raw material to the paper manufacturing process; 2) intermediate water products resulting from any step of the process for manufacturing the paper material; as well as 3) waste water as an output or by-product of the process. In a particular embodiment, the process water is, has been, is being, or is intended for being circulated (re-circulated), i.e., re-used in another step of the process. The term "water" in turn means any aqueous medium, solution, suspension, e.g., ordinary tap water, and tap water in admixture with various additives and adjuvants commonly used in paper manufacturing processes. In a particular embodiment the process water has a low content of solid (dry) matter, e.g., below 20%, 18%, 16%, 14%, 12%, 10%, 8%, 7%, 6%, 5%, 4%, 3%, 20% or below 1% dry matter.

The process of the invention may be carried out at conventional conditions in the paper and pulp processing. The process conditions will be a function of the polypeptide (s) applied, the reaction time and the conditions given.

The GH61 polypeptide of the invention should be added in an effective amount. By the term "effective amount" is meant the amount sufficient to achieve the desired and expected effect, such as improving pulp freeness and/or paper or packaging material strength.

In a particular embodiment, the dosage of the GH61 polypeptide and additional enzymes, if any, is from about 0.1 mg enzyme protein to about 100,000 mg enzyme protein (of each polypeptide) per ton of paper pulp.

In further particular embodiments, the amount of the GH61 polypeptide and additional enzymes, if any, is in the range of 0.00001-20; or 0.0001-20 mg of polypeptide (calculated as pure protein) per gram (dry weight) of pulp material, such as 0.0001-10 mg/g, 0.0001-1 mg/g, 0.001-1 mg/g, 0.001-0.1, or 0.01-0.1 mg of polypeptide per gram of pulp material. Again, these amounts refer to the amount of each polypeptide.

The GH61 polypeptide treatment can be done at conventional consistency, e.g., 0.1-10% dry substance. In particular embodiments, the consistency is within the range of 0.1-45%; 0.1-40%; 0.1-35%; 0.1-30%; 0.1-25%; 0.1-20%; 0.1-15%; 0.1-10%; 0.1-8%; 0.1-6%; or 0.1-5% dry substance.

The GH61 polypeptide treatment may be carried out at a temperature of from about 10° C. to about 100° C. Further examples of temperature ranges (all "from about" and "to about") are the following: 20-120° C., 30-120° C., 35-120° C., 37-120° C., 40-120° C., 50-120° C., 60-120° C., 70-120° C., 10-100° C., 10-90° C., 10-80° C., 10-70° C., 10-60° C., and 30-60° C., as well as any combination of the upper and lower values here indicated. A typical temperature is from about 20 to 90° C., or 20 to 95° C., preferably from about 40 to 70° C., or 40 to 75° C. Usually, the GH61 polypeptide treatment is carried out at atmospheric pressure. But when the temperature exceeds 100° C., the treatment is carried out at a pressure of 1-2 bar (up to 1 bar above atmospheric pressure).

The GH61 polypeptide treatment is carried out at a pH of from about 3 to about 10, preferably at a pH from about 3.5 to about 9, more preferably at a pH from about 4 to about 8, and most preferably at a pH from about 5 to about 7.

A suitable duration of the GH61 polypeptide treatment may be in the range from a few seconds to several hours, e.g., from about 30 seconds to about 48 hours, or from about 1 minute to about 24 hours, or from about 1 minute to about 18 hours, or from about 1 minute to about 12 hours, or from about 1 minute to 5 hours, or from about 1 minute to about 2 hours, or from about 1 minute to about 1 hour, or from about 1 minute to about 30 minutes. A typical reaction time is from about 10 minutes to 3 hours, 10 minutes to 10 hours, preferably 15 minutes to 1 hour, or 15 minutes to 2 hours.

Molecular oxygen from the atmosphere will usually be present in sufficient quantity, if required. Therefore, the reaction may conveniently be carried out in an open reactor, i.e., at atmospheric pressure.

Various additives over and above the GH61 polypeptide and additional enzymes, if any, can be used in the process or use of the invention. Surfactants and/or dispersants are often present in, and/or added to a pulp. Thus the process and use of the present invention may be carried out in the presence of an anionic, non-ionic, cationic and/or zwitterionic surfactant and/or dispersant conventionally used in a pulp. Examples of anionic surfactants are carboxylates, sulphates, sulphonates or phosphates of alkyl, substituted alkyl or aryl. Examples of non-ionic surfactants are polyoxyethylene compounds, such as alcohol ethoxylates, propoxylates or mixed ethoxy-/propoxylates, poly-glycerols and other polyols, as well as certain block-copolymers. Examples of cationic surfactants are water-soluble cationic polymers, such as quartenary ammonium sulphates and certain amines, e.g., epichlorohydrin/dimethylamine polymers (EPI-DMA) and cross-linked solutions thereof, polydiallyl dimethyl ammonium chloride (DADMAC), DADMAC/Acrylamide co-polymers, and ionene polymers, such as those disclosed in U.S. Pat. Nos. 5,681,862; and 5,575,993. Examples of zwitterionic or amphoteric surfactants are betains, glycinates, amino propionates, imino propionates and various imidazolin-derivatives. Also the polymers disclosed in U.S. Pat. No. 5,256,252 may be used.

Also according to the invention, surfactants such as the above, including any combination thereof, may be used in a paper making process together with a GH61 polypeptide as defined herein, and included in a composition together with such polypeptide. The amount of each surfactant in such composition may amount to from about 1 to about 1000 ppm of the composition. In particular embodiments the amount of each surfactant is from about 10 to about 1000 ppm, or from about 10 to about 500 ppm, or from about 50 to about 500 ppm.

In another particular embodiment, each of the above ranges refers to the total amount of surfactants.

In further particular embodiments of the above method, and of the process of the invention, the GH61 polypeptide is used in an amount of 0.005-50 ppm (mg/L), or 0.01-40, 0.02-30, 0.03-25, 0.04-20, 0.05-15, 0.05-10, 0.05-5, 0.05-1, 0.05-0.8, 0.05-0.6, or 0.1-0.5 ppm. The amount of GH61 polypeptide refers to mg of a well-defined polypeptide preparation.

In the process of the invention, the GH61 polypeptide may be applied alone or together with an additional enzyme. The term "an additional enzyme" means at least one additional enzyme, e.g., one, two, three, four, five, six, seven, eight, nine, ten or even more additional enzymes.

The term "applied together with" (or "used together with") means that the additional enzyme may be applied in the same, or in another step of the process of the invention. The other process step may be upstream or downstream in the paper manufacturing process, as compared to the step in which the pulp is contacted with a GH61 polypeptide.

In particular embodiments the additional enzyme is an enzyme which has protease, lipase, xylanase, cutinase, oxidoreductase, glycosyl hydrolase cellulase, endoglucanase, amylase, mannanase, steryl esterase, and/or cholesterol esterase activity. Examples of oxidoreductase enzymes are enzymes with laccase, and/or peroxidase activity. In a preferred embodiment, the additional enzyme is glycosyl hydrolase, such as endoglucanase.

The term "a step" of a process means at least one step, and it could be one, two, three, four, five or even more process steps. In other words the GH61 polypeptide of the invention may be applied in at least one process step, and the additional enzyme(s) may also be applied in at least one process step, which may be the same or a different process step as compared to the step where the GH61 polypeptide is used.

The term "polypeptide preparation" means a product containing at least one GH61 polypeptide. The polypeptide preparation may also comprise enzymes having other enzyme activities, preferably glycosyl hydrolytic enzymes, such as endoglucanase. In addition to the enzymatic activity, such a preparation may also contain at least one adjuvant. Examples of adjuvants, which are used in enzyme preparations for the paper and pulp industry are buffers, polymers, surfactants and stabilizing agents.

Additional Enzymes

Any enzyme having protease, lipase, xylanase, cutinase, laccase, peroxidase, oxidase, cellulose, endoglucanase, amylase, mannanase, steryl esterase, and/or cholesterol esterase activity can be used as additional enzymes in the use and process of the invention. Below some non-limiting examples are listed of such additional enzymes. The enzymes written in capitals are commercial enzymes available from Novozymes NS, Krogshoejvej 36, DK-2880 Bagsvaerd, Denmark. The activity of any of those additional enzymes can be analyzed using any method known in the art for the enzyme in question, including the methods mentioned in the references cited.

Examples of cutinases are those derived from *Humicola insolens* (U.S. Pat. No. 5,827,719); from a strain of *Fusarium*, e.g., *F. roseum culmorum*, or particularly *F. solani pisi* (WO 90/09446; WO 94/14964, WO 94/03578). The cutinase may also be derived from a strain of *Rhizoctonia*, e.g., *R. solani*, or a strain of *Alternaria*, e.g., *A. brassicicola* (WO 94/03578), or variants thereof such as those described in WO 00/34450, or WO 01/92502.

Examples of proteases are the ALCALASE, ESPERASE, SAVINASE, NEUTRASE and DURAZYM proteases. Other proteases are derived from *Nocardiopsis, Aspergillus, Rhizopus, Bacillus alcalophilus, B. cereus, B. natto, B. vulgatus, B. mycoide*, and subtilisins from *Bacillus*, especially proteases from the species *Nocardiopsis* sp. and *Nocardiopsis dassonvillei* such as those disclosed in WO 88/03947, and mutants thereof, e.g., those disclosed in WO 91/00345 and EP 415296.

Examples of amylases are the BAN, AQUAZYM, TERMAMYL, and AQUAZYM Ultra amylases. An example of a lipase is the RESINASE A2X lipase. An example of a xylanase is the PULPZYME HC hemicellulase. Examples of endoglucanases are the NOVOZYM 613, 342, and 476, and NOVOZYM 51081 enzyme products.

Examples of mannanases are the *Trichoderma reesei* endo-beta-mannanases described in Ståhlbrand et al, J. Biotechnol. 29 (1993), 229-242.

Examples of steryl esterases, peroxidases, laccases, and cholesterol esterases are disclosed in the references mentioned in the background art section hereof. Further examples of oxidoreductases are the peroxidases and laccases disclosed in EP 730641; WO 01/98469; EP 719337; EP 765394; EP 767836; EP 763115; and EP 788547. In the present context, whenever an oxidoreductase enzyme is mentioned that requires or benefits from the presence of acceptors (e.g., oxygen or hydrogen peroxide), enhancers, mediators and/or activators, such compounds should be considered to be included. Examples of enhancers and mediators are disclosed in EP 705327; WO 98/56899; EP 677102; EP 781328; and EP 707637. If desired a distinction could be made by defining an oxidoreductase enzyme system (e.g., a laccase, or a peroxidase enzyme system) as the combination of the enzyme in question and its acceptor, and optionally also an enhancer and/or mediator for the enzyme in question.

The invention described and claimed herein is not to be limited in scope by the specific embodiments herein disclosed, since these embodiments are intended as illustrations of several aspects of the invention. Any equivalent embodiments are intended to be within the scope of this invention. Indeed, various modifications of the invention in addition to those shown and described herein will become apparent to those skilled in the art from the foregoing description. Such modifications are also intended to fall within the scope of the appended claims. In the case of conflict, the present disclosure including definitions will control.

Various references are cited herein, the disclosures of which are incorporated by reference in their entireties.

EXAMPLES

Example 1

Improving Freeness of Old Corrugated Container (OCC) Fiber Pulp with GH61 Polypeptides Pulp Model old corrugated container (OCC) fiber pulp was prepared by soaking 100 oven dry grams (odg) of hand-torn corrugated cardboard box in 2 L of deionized water overnight at room temperature and then disintegrating the soaked material for 20,000 revolutions in a standard laboratory disintegrator. The resultant pulp was then vacuum filtered and the resultant cake 'scattered' to small pieces, transferred to a sealable plastic bag and stored for 24 hours at 4° C. until use.

Reagents & Enzymes

Stock solutions of GH61 cofactors were prepared according to Table 1. Enzymes used in the trial are described in Table 2.

TABLE 1

Stock solutions

| Reagent | Concentration | Preparation |
|---|---|---|
| Pyrogallol, 279KEM00218 | 3.17M | Dissolve 4.0 g of pyrogallol in 10 ml MQ $H_2O$ |
| $CuSO_4$, 279KEM00098 | 10 mM | Dissolve 0.5 g of $CuSO_4 \cdot 5H_2O$ in 200 ml of MQ $H_2O$ |

TABLE 2

Enzymes used in the trial

| Enzyme | Description |
|---|---|
| Endoglucanase | Endoglucanase shown as SEQ ID NO: 36, which is a Q120H variant of the mature endoglucanase shown as SEQ ID NO: 9 of WO 96/29397. Also available as Renozyme ™ from Novozymes A/S, Denmark. |
| GH61 | 1:1:1 mixture of three mature GH61s from *Acremonium alcalophilum* shown as SEQ ID NO: 1, SEQ ID NO: 2, and SEQ ID NO: 3 |

Procedure

Aliquots of the model pulp, equivalent to 20 oven dry grams of solids, were placed in each of eight 1 L stainless steel Lab-O-Mat beakers and diluted to target consistency and pH with buffer according to Table 3. Enzymes and cofactors were added to each beaker according to the dosing schedule presented in Table 4. The beakers were sealed and placed in the Lab-O-Mat and incubation conducted according to the conditions described in Table. After incubation, the contents of each beaker were diluted to 2 L with deionized water, disintegrated for 10,000 revolutions and diluted to 5 L (0.4% consistency). Duplicate 'freeness' values were determined from each diluted pulp sample and three 2.6 gram handsheets (equivalent to 130 g/m$^2$ basis weight), were prepared from each for drying and testing according to TAPPI standard procedure.

TABLE 3

Constant trial parameters

| Parameter | Value |
|---|---|
| Substrate | Old corrugated container (OCC) |
| Oven Dry weight per trial | 20 g |
| Consistency | 3.4% w/v |
| Buffer | Britton-Robinson 40 mM (pH 7) |
| Enzyme Dose | See Table 4 |
| Temperature | 50° C. |
| pH | 7 |
| Retention time | 240 min |
| Incubation vessel | Lab-O-Mat (20 rpm, 30 s left, 30 s right), no $O_2$ pressurization |

TABLE 4

Enzyme and cofactor dosing schedule

| # | Total fiber (odg) | GH61 (g EP/DT) | Endoglucanase (g EP/DT) | Pyrogallol (mM) | $CuSO_4$ (mM) |
|---|---|---|---|---|---|
| 1 | 20 | 0 | 0 | 2.00 | 0.01 |
| 2 | 20 | 30 | 1.125 | 2.00 | 0.01 |
| 3 | 20 | 30 | 2.250 | 2.00 | 0.01 |
| 4 | 20 | 30 | 5.625 | 2.00 | 0.01 |
| 5 | 20 | 12 | 0 | 2.00 | 0.01 |
| 6 | 20 | 300 | 1.125 | 2.00 | 0.01 |
| 7 | 20 | 300 | 2.250 | 2.00 | 0.01 |
| 8 | 20 | 300 | 5.625 | 2.00 | 0.01 |

Results

Table 5 presents the freeness values obtained from 0.4% slurries of untreated fiber (i.e., control) and enzymatically pre-treated fiber. While the application of endoglucanase alone increased the freeness, the addition of GH61 in concert with the endoglucanase boosted the improvement. Surprisingly, the addition of GH61 alone, at 12 grams of enzyme protein per dry ton of pulp solids, improved freeness by 7% relative to the untreated control.

Interestingly, only the trial in which GH61 was added in the absence of endoglucanase was able to generate handsheets with improved short span compression strength relative to the untreated control (Table 6).

TABLE 5

Canadian standard freeness (CSF) values obtained from pulp slurries (0.4%) prepared from fiber pre-treated with blends of endoglucanase and GH61. Endoglucanase and GH61 doses are given as grams of enzyme protein (EP) per DT of fiber.

| # | GH61 (g EP/DT) | Endoglucanase (g EP/DT) | CSF | Delta |
|---|---|---|---|---|
| 1 | 0 | 0 | 519.1 | 0% |
| 2 | 30 | 1.125 | 573.7 | 11% |
| 3 | 30 | 2.250 | 581.3 | 12% |
| 4 | 30 | 5.625 | 591.6 | 14% |
| 5 | 12 | 0 | 556.2 | 7% |
| 6 | 100 | 1.125 | 584.6 | 13% |
| 7 | 200 | 2.250 | 589.5 | 14% |
| 8 | 500 | 5.625 | 615.6 | 19% |

TABLE 6

Short span compression strength (SCT) indices obtained from 130 g/m$^2$ handsheets prepared with fiber pre-treated with endoglucanase and GH61.

| # | GH61 (g/DT) | Endoglucanase (g/DT) | Short Span Compressive Strength Index (Nm/g) | Delta |
|---|---|---|---|---|
| 1 | 0 | 0 | 13.12 | 0% |
| 2 | 30 | 1.125 | 12.51 | −5% |
| 3 | 30 | 2.250 | 13.14 | 0% |
| 4 | 30 | 5.625 | 12.52 | −5% |
| 5 | 12 | 0 | 14.01 | 7% |
| 6 | 100 | 1.125 | 12.54 | −4% |
| 7 | 200 | 2.250 | 12.39 | −6% |
| 8 | 500 | 5.625 | 12.20 | −7% |

Example 2

Improving Freeness of Recovered Pulp with GH61 Polypeptides

Pulp

Recovered pulp, obtained from a recycled linerboard mill, was used 'as received' in the subsequent trials. Pulp characteristics include 3% consistency and pH 6.3.

Reagents & Enzymes

Stock solutions of GH61 cofactors were prepared according to Table. Enzymes used in the trial are described in Table 8.

TABLE 7

Stock solutions

| Reagent | Concentration | Preparation |
|---|---|---|
| Pyrogallol, 279KEM00218 | 3.17M | Dissolve 4.0 g of pyrogallol in 10 ml MQ $H_2O$ |
| $CuSO_4$, 279KEM00098 | 10 mM | Dissolve 0.5 g of $CuSO_4 \cdot 5H_2O$ in 200 ml of MQ $H_2O$ |

TABLE 8

Enzymes used in the trial

| Enzyme | Description |
|---|---|
| Endoglucanase | Endoglucanase shown as SEQ ID NO: 36, which is a Q120H variant of the mature endoglucanase shown as SEQ ID NO: 9 of WO 96/29397. Also available as Renozyme ™ from Novozymes A/S, Denmark. |
| GH61 | 1:1:1 mixture of three mature GH61s from *Acremonium alcalophilum* shown as SEQ ID NO: 1, SEQ ID NO: 2, and SEQ ID NO: 3. |

Procedure

Aliquots of the recycled fiber, equivalent to 20 oven dry grams of solids, were placed in each of eight 1 L stainless steel Lab-O-Mat beakers according to Table 9. Enzymes and cofactors were added to each beaker according to the dosing schedule presented in Table 10. The beakers were sealed and placed in the Lab-O-Mat and incubation conducted according to the conditions described in Table 9. After incubation, the contents of each beaker were diluted to 2 L with deionized water, disintegrated for 10,000 revolutions and diluted to 5 L (0.4% consistency). Duplicate 'freeness' values were determined from each diluted pulp sample and three 2.6 gram handsheets (equivalent to 130 g/m$^2$ basis weight), were prepared from each for drying and testing according to TAPPI standard procedure.

TABLE 9

Constant trial parameters

| Parameter | Value |
|---|---|
| Substrate | Recovered fiber ('OCC') |
| Oven Dry weight per trial | 20 g |
| Consistency | 3% w/v |
| Enzyme Dose | See Table 10 |
| Temperature | 50° C. |
| pH | 6.3 |
| Retention time | 120 min |
| Incubation vessel | Lab-O-Mat (20 rpm, 30 s left, 30 s right), no $O_2$ pressurization |

TABLE 1

Enzyme and cofactor dosing schedule

| # | Total fiber (odg) | GH61 (g EP/DT) | Endoglucanase (g EP/DT) | Pyrogallol (mM) | $CuSO_4$ (mM) |
|---|---|---|---|---|---|
| 1 | 20 | 0 | 0 | 2.00 | 0.01 |
| 2 | 20 | 15 | 0 | 2.00 | 0.01 |
| 3 | 20 | 30 | 0 | 2.00 | 0.01 |
| 4 | 20 | 300 | 0 | 2.00 | 0.01 |
| 5 | 20 | 0 | 11.25 | 2.00 | 0.01 |
| 6 | 20 | 15 | 11.25 | 2.00 | 0.01 |
| 7 | 20 | 30 | 11.25 | 2.00 | 0.01 |
| 8 | 20 | 300 | 11.25 | 2.00 | 0.01 |

Results

Table 11 presents the results clearly demonstrating that freeness may be significantly improved by up to 21% by the pre-treatment of the pulp with GH61 alone. Furthermore, the addition of GH61 in concert with endoglucanase improved the freeness relative to the endoglucanase alone. However, increasing the amount of GH61 protein within the GH61/endoglucanase blend beyond 15 grams per oven dry ton, did not significantly enhance freeness relative to lower doses of GH61.

TABLE 11

Canadian standard freeness (CSF) values obtained from pulp slurries (0.4%) prepared from fiber pre-treated with blends of endoglucanase and GH61. Endoglucanase and GH61 doses are given as grams of enzyme protein (EP) per DT of fiber.

| # | GH61 (g EP/DT) | Endoglucanase (g EP/DT) | CSF | Delta |
|---|---|---|---|---|
| 1 | 0 | 0 | 173 | 0% |
| 2 | 15 | 0 | 175 | 1% |
| 3 | 30 | 0 | 192 | 10% |
| 4 | 300 | 0 | 210 | 21% |
| 5 | 0 | 11.25 | 287 | 65% |
| 6 | 15 | 11.25 | 324 | 87% |
| 7 | 30 | 11.25 | 331 | 91% |
| 8 | 300 | 11.25 | 325 | 87% |

SEQUENCE LISTING

<160> NUMBER OF SEQ ID NOS: 36

<210> SEQ ID NO 1
<211> LENGTH: 223
<212> TYPE: PRT
<213> ORGANISM: Acremonium alcalophilum

<400> SEQUENCE: 1

His Thr Ile Phe Thr Ser Leu Glu Val Gly Gly Thr Asn Ala Gly Thr
1 5 10 15

Gly His Gly Val Arg Val Pro Ser Tyr Asn Gly Pro Ile Glu Asp Val
20 25 30

Thr Ser Asn Ser Met Ala Cys Asn Gly Pro Pro Asn Pro Thr Thr Pro
35 40 45

Thr Asp Lys Ile Ile Thr Val Gln Ala Gly Asp Thr Val His Ala Ile
50 55 60

Trp Arg Tyr Met Leu Ser Thr Thr Gly Ser Ala Pro Asn Asp Ile Met
65 70 75 80

Asp Ser Ser His Lys Gly Pro Thr Met Ala Tyr Leu Lys Lys Val Asp
85 90 95

Asn Ala Val Thr Asp Ser Gly Val Gly Asp Gly Trp Phe Lys Ile Gln
100 105 110

Glu Asp Gly Phe Gly Ser Asp Gly Ile Trp Gly Thr Glu Arg Ile Ile
115 120 125

Asn Gly Gln Gly Arg His Ala Ile Arg Ile Pro Glu Cys Ile Glu Pro
130 135 140

Gly Gln Tyr Leu Leu Arg Ala Glu Met Leu Ala Leu His Ala Ala Gly
145 150 155 160

Ser Tyr Pro Gly Ala Gln Phe Tyr Met Glu Cys Ala Gln Ile Asn Val
165 170 175

Val Gly Gly Thr Gly Thr Lys Thr Pro Ser Thr Val Ser Phe Pro Gly
180 185 190

Ala Tyr Lys Gly Ser Asp Pro Gly Val Thr Ile Ser Ile Trp Trp Pro
195 200 205

Pro Val Thr Asn Tyr Gln Ile Pro Gly Pro Asp Val Phe Thr Cys
210 215 220

<210> SEQ ID NO 2
<211> LENGTH: 245
<212> TYPE: PRT
<213> ORGANISM: Acremonium alcalophilum

<400> SEQUENCE: 2

His Tyr Asn Phe Glu Ser Leu Val Val Asn Gly Gln Ala Thr Gly Pro
1 5 10 15

Tyr Glu Tyr Val Arg Arg Thr Thr Asn Ser Asn Ser Pro Ile Glu Asp
20 25 30

Val Gln Ser Gln Asn Met Ile Cys Asn Gln Gly Gly Leu Asp Ala Asn
35 40 45

Ile Arg Ala Ala Thr Ser Thr Arg Thr Val Gln Ala Gly Asp Glu Leu
50 55 60

Gly Phe Leu Val Asn Val Asp Leu Gly His Pro Gly Pro Leu Ala Val
65 70 75 80

Tyr Leu Ser Arg Ala Pro Asp Gly Val Ser Ala Gln Asp Tyr Leu Gly
85 90 95

Asp Gly Glu Trp Phe Lys Ile Tyr Ala Leu Thr Ser Arg Glu Ile Arg

```
            100                 105                 110

Pro Asn Val Gly Ile Asp Trp Ala Ser Phe Pro Asn Ser Val Gly Ile
        115                 120                 125

Arg Asn Phe Thr Phe Thr Leu Pro Pro Gln Thr Pro Pro Gly Asp Tyr
    130                 135                 140

Leu Leu Arg Ala Glu His Leu Ala Ile His Gly Ala Gly Asn Phe Gly
145                 150                 155                 160

Gly Ala Gln Phe Tyr Met Gly Cys Ala Gln Leu Thr Ile Glu Asn Asp
                165                 170                 175

Asn Tyr Asp Gly Ser Ile Pro Gly Pro Thr Val Arg Phe Pro Gly Ala
            180                 185                 190

Tyr Thr Gly Tyr Glu Pro Gly Ile Leu Val Asn Ile Tyr Trp Pro Pro
        195                 200                 205

Leu Thr Ser Tyr Glu Ala Pro Gly Pro Leu Thr Trp Pro Asn Arg Cys
    210                 215                 220

Glu Asp His Thr Ala Asn Leu Val Gly Gln Gln Ser Asp Gly Asp Cys
225                 230                 235                 240

Thr Pro Leu Gly Ser
                245


<210> SEQ ID NO 3
<211> LENGTH: 399
<212> TYPE: PRT
<213> ORGANISM: Acremonium alcalophilum

<400> SEQUENCE: 3

His Met Glu Ile Ser Trp Pro Pro Pro Leu Arg Ser Lys Tyr Asn Pro
1               5                   10                  15

Phe Ala Gly Gly Asp Ile Asp Tyr Ser Met Thr Ser Pro Leu Ser Ala
            20                  25                  30

Ser Gly Ser Asp Phe Pro Cys Lys Gly Ser Leu Ser Leu Leu Gly Ser
        35                  40                  45

Asp Ala Ala Leu Pro Val Thr Ser Tyr Glu Ala Gly Gln Thr Tyr Asn
    50                  55                  60

Met Thr Ile Thr Gly Gly Ala His His Asn Gly Gly Ser Cys Gln Ala
65                  70                  75                  80

Ser Leu Ser Phe Asp Gly Gly Asn Thr Phe Ser Val Ile His Ser Tyr
                85                  90                  95

Ile Gly Gly Cys Pro Pro Ala Gly Thr Ser Ser Tyr Asp Phe Thr Ile
            100                 105                 110

Pro Ala Asp Ala Pro Ser Ala Asp Asn Ala Ile Phe Ala Trp Thr Trp
        115                 120                 125

Phe Asn Gln Ile Gly Asn Arg Glu Met Tyr Met Asn Cys Ala Val Val
    130                 135                 140

Ser Ile Gln Gly Ser Gly Thr Ser Thr Ser Ser Leu Ala Gly Arg Pro
145                 150                 155                 160

Glu Ile Met Ile Ala Asn Val Gly Asn Gly Cys Ser Thr Thr Glu Gly
                165                 170                 175

Thr Asp Val Glu Phe Pro Asn Pro Gly Pro Asp Val Thr Val Ala Gly
            180                 185                 190

Ser Ala Thr Thr Pro Pro Leu Gly Ser Cys Gly Gly Gly Ser Gly Gly
        195                 200                 205

Gly Asn Ser Gly Gly Asp Asn Gly Gly Asp Gly Asn Arg Ser Asn Pro
    210                 215                 220
```

```
Asp Glu Gly Ser Asn Pro Gly Val Pro Thr Ile Gln Pro Asp Gln Pro
225                 230                 235                 240

Ala Ile Lys Pro Asp Gln Pro Val Pro Glu Leu Pro Lys Thr Thr Thr
                245                 250                 255

Ser Leu Pro Gly Gly Val Phe Ile Pro Leu Pro Ser Glu Ala Pro Pro
            260                 265                 270

Ala Glu Arg Leu Ser Thr Leu Thr Thr Val Thr Ile Pro Thr Thr Thr
        275                 280                 285

Ala Pro Pro Ser Gln Pro Thr Ser Ser Pro Gly Glu Glu Glu Ala Cys
    290                 295                 300

Asp Asp Val Glu Asp Gly Val Glu Asp Gly Val Gln Asp Asp Val Gln
305                 310                 315                 320

Asp Gly Val Glu Asp Gly Val Glu Asp Gly Val Gln Asp Gly Ala Gln
                325                 330                 335

Asn Pro Gly Thr Ala Cys Ala Asn Glu Gly Gln Trp Asn Cys Leu Gly
            340                 345                 350

Gly Thr His Phe Gln Arg Cys Ala Ser Gly Val Trp Ser Gln Leu Met
        355                 360                 365

Gln Met Ala Ala Gly Thr Thr Cys Glu Ala Gly Leu Ser Glu Thr Leu
    370                 375                 380

Ile Met Ile Arg Lys Arg Gly Gly Ala Arg Arg Phe Leu Ile Leu
385                 390                 395


<210> SEQ ID NO 4
<211> LENGTH: 326
<212> TYPE: PRT
<213> ORGANISM: Thielavia terrestris

<400> SEQUENCE: 4

Met Lys Ser Phe Thr Ile Ala Ala Leu Ala Ala Leu Trp Ala Gln Glu
1               5                   10                  15

Ala Ala Ala His Ala Thr Phe Gln Asp Leu Trp Ile Asp Gly Val Asp
            20                  25                  30

Tyr Gly Ser Gln Cys Val Arg Leu Pro Ala Ser Asn Ser Pro Val Thr
        35                  40                  45

Asn Val Ala Ser Asp Asp Ile Arg Cys Asn Val Gly Thr Ser Arg Pro
    50                  55                  60

Thr Val Lys Cys Pro Val Lys Ala Gly Ser Thr Val Thr Ile Glu Met
65                  70                  75                  80

His Gln Gln Pro Gly Asp Arg Ser Cys Ala Asn Glu Ala Ile Gly Gly
                85                  90                  95

Asp His Tyr Gly Pro Val Met Val Tyr Met Ser Lys Val Asp Asp Ala
            100                 105                 110

Val Thr Ala Asp Gly Ser Ser Gly Trp Phe Lys Val Phe Gln Asp Ser
        115                 120                 125

Trp Ala Lys Asn Pro Ser Gly Ser Thr Gly Asp Asp Asp Tyr Trp Gly
    130                 135                 140

Thr Lys Asp Leu Asn Ser Cys Cys Gly Lys Met Asn Val Lys Ile Pro
145                 150                 155                 160

Glu Asp Ile Glu Pro Gly Asp Tyr Leu Leu Arg Ala Glu Val Ile Ala
                165                 170                 175

Leu His Val Ala Ala Ser Ser Gly Gly Ala Gln Phe Tyr Met Ser Cys
            180                 185                 190

Tyr Gln Leu Thr Val Thr Gly Ser Gly Ser Ala Thr Pro Ser Thr Val
        195                 200                 205
```

```
Asn Phe Pro Gly Ala Tyr Ser Ala Ser Asp Pro Gly Ile Leu Ile Asn
    210                 215                 220

Ile His Ala Pro Met Ser Thr Tyr Val Val Pro Gly Pro Thr Val Tyr
225                 230                 235                 240

Ala Gly Gly Ser Thr Lys Ser Ala Gly Ser Ser Cys Ser Gly Cys Glu
                245                 250                 255

Ala Thr Cys Thr Val Gly Ser Gly Pro Ser Ala Thr Leu Thr Gln Pro
            260                 265                 270

Thr Ser Thr Ala Thr Ala Thr Ser Ala Pro Gly Gly Gly Gly Ser Gly
        275                 280                 285

Cys Thr Ala Ala Lys Tyr Gln Gln Cys Gly Gly Thr Gly Tyr Thr Gly
    290                 295                 300

Cys Thr Thr Cys Ala Ser Gly Ser Thr Cys Ser Ala Val Ser Pro Pro
305                 310                 315                 320

Tyr Tyr Ser Gln Cys Leu
                325


<210> SEQ ID NO 5
<211> LENGTH: 239
<212> TYPE: PRT
<213> ORGANISM: Thielavia terrestris

<400> SEQUENCE: 5

Met Arg Phe Asp Ala Leu Ser Ala Leu Ala Leu Ala Pro Leu Val Ala
1               5                   10                  15

Gly His Gly Ala Val Thr Ser Tyr Ile Ile Gly Gly Lys Thr Tyr Pro
            20                  25                  30

Gly Tyr Glu Gly Phe Ser Pro Ala Ser Ser Pro Pro Thr Ile Gln Tyr
        35                  40                  45

Gln Trp Pro Asp Tyr Asn Pro Thr Leu Ser Val Thr Asp Pro Lys Met
    50                  55                  60

Arg Cys Asn Gly Gly Thr Ser Ala Glu Leu Ser Ala Pro Val Gln Ala
65                  70                  75                  80

Gly Glu Asn Val Thr Ala Val Trp Lys Gln Trp Thr His Gln Gln Gly
                85                  90                  95

Pro Val Met Val Trp Met Phe Lys Cys Pro Gly Asp Phe Ser Ser Ser
            100                 105                 110

His Gly Asp Gly Lys Gly Trp Phe Lys Ile Asp Gln Leu Gly Leu Trp
        115                 120                 125

Gly Asn Asn Leu Asn Ser Asn Asn Trp Gly Thr Ala Ile Val Tyr Lys
    130                 135                 140

Thr Leu Gln Trp Ser Asn Pro Ile Pro Lys Asn Leu Ala Pro Gly Asn
145                 150                 155                 160

Tyr Leu Ile Arg His Glu Leu Leu Ala Leu His Gln Ala Asn Thr Pro
                165                 170                 175

Gln Phe Tyr Ala Glu Cys Ala Gln Leu Val Val Ser Gly Ser Gly Ser
            180                 185                 190

Ala Leu Pro Pro Ser Asp Tyr Leu Tyr Ser Ile Pro Val Tyr Ala Pro
        195                 200                 205

Gln Asn Asp Pro Gly Ile Thr Val Asp Ile Tyr Asn Gly Gly Leu Thr
    210                 215                 220

Ser Tyr Thr Pro Pro Gly Gly Pro Val Trp Ser Gly Phe Glu Phe
225                 230                 235
```

<210> SEQ ID NO 6
<211> LENGTH: 258
<212> TYPE: PRT
<213> ORGANISM: Thielavia terrestris

<400> SEQUENCE: 6

Met Leu Leu Thr Ser Val Leu Gly Ser Ala Ala Leu Leu Ala Ser Gly
1 5 10 15

Ala Ala Ala His Gly Ala Val Thr Ser Tyr Ile Ile Ala Gly Lys Asn
20 25 30

Tyr Pro Gly Tyr Gln Gly Phe Ser Pro Ala Asn Ser Pro Asn Val Ile
35 40 45

Gln Trp Gln Trp His Asp Tyr Asn Pro Val Leu Ser Cys Ser Asp Ser
50 55 60

Lys Leu Arg Cys Asn Gly Gly Thr Ser Ala Thr Leu Asn Ala Thr Ala
65 70 75 80

Ala Pro Gly Asp Thr Ile Thr Ala Ile Trp Ala Gln Trp Thr His Ser
85 90 95

Gln Gly Pro Ile Leu Val Trp Met Tyr Lys Cys Pro Gly Ser Phe Ser
100 105 110

Ser Cys Asp Gly Ser Gly Ala Gly Trp Phe Lys Ile Asp Glu Ala Gly
115 120 125

Phe His Gly Asp Gly Val Lys Val Phe Leu Asp Thr Glu Asn Pro Ser
130 135 140

Gly Trp Asp Ile Ala Lys Leu Val Gly Gly Asn Lys Gln Trp Ser Ser
145 150 155 160

Lys Val Pro Glu Gly Leu Ala Pro Gly Asn Tyr Leu Val Arg His Glu
165 170 175

Leu Ile Ala Leu His Gln Ala Asn Asn Pro Gln Phe Tyr Pro Glu Cys
180 185 190

Ala Gln Val Val Ile Thr Gly Ser Gly Thr Ala Gln Pro Asp Ala Ser
195 200 205

Tyr Lys Ala Ala Ile Pro Gly Tyr Cys Asn Gln Asn Asp Pro Asn Ile
210 215 220

Lys Val Pro Ile Asn Asp His Ser Ile Pro Gln Thr Tyr Lys Ile Pro
225 230 235 240

Gly Pro Pro Val Phe Lys Gly Thr Ala Ser Lys Lys Ala Arg Asp Phe
245 250 255

Thr Ala

<210> SEQ ID NO 7
<211> LENGTH: 226
<212> TYPE: PRT
<213> ORGANISM: Thielavia terrestris

<400> SEQUENCE: 7

Met Leu Ala Asn Gly Ala Ile Val Phe Leu Ala Ala Ala Leu Gly Val
1 5 10 15

Ser Gly His Tyr Thr Trp Pro Arg Val Asn Asp Gly Ala Asp Trp Gln
20 25 30

Gln Val Arg Lys Ala Asp Asn Trp Gln Asp Asn Gly Tyr Val Gly Asp
35 40 45

Val Thr Ser Pro Gln Ile Arg Cys Phe Gln Ala Thr Pro Ser Pro Ala
50 55 60

Pro Ser Val Leu Asn Thr Thr Ala Gly Ser Thr Val Thr Tyr Trp Ala
65 70 75 80

```
Asn Pro Asp Val Tyr His Pro Gly Pro Val Gln Phe Tyr Met Ala Arg
                85                  90                  95

Val Pro Asp Gly Glu Asp Ile Asn Ser Trp Asn Gly Asp Gly Ala Val
            100                 105                 110

Trp Phe Lys Val Tyr Glu Asp His Pro Thr Phe Gly Ala Gln Leu Thr
        115                 120                 125

Trp Pro Ser Thr Gly Lys Ser Ser Phe Ala Val Pro Ile Pro Pro Cys
    130                 135                 140

Ile Lys Ser Gly Tyr Tyr Leu Leu Arg Ala Glu Gln Ile Gly Leu His
145                 150                 155                 160

Val Ala Gln Ser Val Gly Gly Ala Gln Phe Tyr Ile Ser Cys Ala Gln
                165                 170                 175

Leu Ser Val Thr Gly Gly Gly Ser Thr Glu Pro Pro Asn Lys Val Ala
            180                 185                 190

Phe Pro Gly Ala Tyr Ser Ala Thr Asp Pro Gly Ile Leu Ile Asn Ile
        195                 200                 205

Tyr Tyr Pro Val Pro Thr Ser Tyr Gln Asn Pro Gly Pro Ala Val Phe
    210                 215                 220

Ser Cys
225


<210> SEQ ID NO 8
<211> LENGTH: 304
<212> TYPE: PRT
<213> ORGANISM: Thielavia terrestris

<400> SEQUENCE: 8

Met Lys Gly Leu Phe Ser Ala Ala Ala Leu Ser Leu Ala Val Gly Gln
1               5                   10                  15

Ala Ser Ala His Tyr Ile Phe Gln Gln Leu Ser Ile Asn Gly Asn Gln
            20                  25                  30

Phe Pro Val Tyr Gln Tyr Ile Arg Lys Asn Thr Asn Tyr Asn Ser Pro
        35                  40                  45

Val Thr Asp Leu Thr Ser Asp Asp Leu Arg Cys Asn Val Gly Ala Gln
    50                  55                  60

Gly Ala Gly Thr Asp Thr Val Thr Val Lys Ala Gly Asp Gln Phe Thr
65                  70                  75                  80

Phe Thr Leu Asp Thr Pro Val Tyr His Gln Gly Pro Ile Ser Ile Tyr
                85                  90                  95

Met Ser Lys Ala Pro Gly Ala Ala Ser Asp Tyr Asp Gly Ser Gly Gly
            100                 105                 110

Trp Phe Lys Ile Lys Asp Trp Gly Pro Thr Phe Asn Ala Asp Gly Thr
        115                 120                 125

Ala Thr Trp Asp Met Ala Gly Ser Tyr Thr Tyr Asn Ile Pro Thr Cys
    130                 135                 140

Ile Pro Asp Gly Asp Tyr Leu Leu Arg Ile Gln Ser Leu Ala Ile His
145                 150                 155                 160

Asn Pro Trp Pro Ala Gly Ile Pro Gln Phe Tyr Ile Ser Cys Ala Gln
                165                 170                 175

Ile Thr Val Thr Gly Gly Gly Asn Gly Asn Pro Gly Pro Thr Ala Leu
            180                 185                 190

Ile Pro Gly Ala Phe Lys Asp Thr Asp Pro Gly Tyr Thr Val Asn Ile
        195                 200                 205

Tyr Thr Asn Phe His Asn Tyr Thr Val Pro Gly Pro Glu Val Phe Ser
```

```
    210                 215                 220

Cys Asn Gly Gly Gly Ser Asn Pro Pro Pro Pro Val Ser Ser Ser Thr
225                 230                 235                 240

Pro Ala Thr Thr Thr Leu Val Thr Ser Thr Arg Thr Thr Ser Ser Thr
                245                 250                 255

Ser Ser Ala Ser Thr Pro Ala Ser Thr Gly Gly Cys Thr Val Ala Lys
            260                 265                 270

Trp Gly Gln Cys Gly Gly Asn Gly Tyr Thr Gly Cys Thr Thr Cys Ala
        275                 280                 285

Ala Gly Ser Thr Cys Ser Lys Gln Asn Asp Tyr Tyr Ser Gln Cys Leu
    290                 295                 300


<210> SEQ ID NO 9
<211> LENGTH: 317
<212> TYPE: PRT
<213> ORGANISM: Thielavia terrestris

<400> SEQUENCE: 9

Met Lys Gly Leu Ser Leu Leu Ala Ala Ala Ser Ala Ala Thr Ala His
1               5                   10                  15

Thr Ile Phe Val Gln Leu Glu Ser Gly Gly Thr Thr Tyr Pro Val Ser
            20                  25                  30

Tyr Gly Ile Arg Asp Pro Ser Tyr Asp Gly Pro Ile Thr Asp Val Thr
        35                  40                  45

Ser Asp Ser Leu Ala Cys Asn Gly Pro Pro Asn Pro Thr Thr Pro Ser
    50                  55                  60

Pro Tyr Ile Ile Asn Val Thr Ala Gly Thr Thr Val Ala Ala Ile Trp
65                  70                  75                  80

Arg His Thr Leu Thr Ser Gly Pro Asp Asp Val Met Asp Ala Ser His
                85                  90                  95

Lys Gly Pro Thr Leu Ala Tyr Leu Lys Lys Val Asp Asp Ala Leu Thr
            100                 105                 110

Asp Thr Gly Ile Gly Gly Gly Trp Phe Lys Ile Gln Glu Ala Gly Tyr
        115                 120                 125

Asp Asn Gly Asn Trp Ala Thr Ser Thr Val Ile Thr Asn Gly Gly Phe
    130                 135                 140

Gln Tyr Ile Asp Ile Pro Ala Cys Ile Pro Asn Gly Gln Tyr Leu Leu
145                 150                 155                 160

Arg Ala Glu Met Ile Ala Leu His Ala Ala Ser Thr Gln Gly Gly Ala
                165                 170                 175

Gln Leu Tyr Met Glu Cys Ala Gln Ile Asn Val Val Gly Gly Ser Gly
            180                 185                 190

Ser Ala Ser Pro Gln Thr Tyr Ser Ile Pro Gly Ile Tyr Gln Ala Thr
        195                 200                 205

Asp Pro Gly Leu Leu Ile Asn Ile Tyr Ser Met Thr Pro Ser Ser Gln
    210                 215                 220

Tyr Thr Ile Pro Gly Pro Pro Leu Phe Thr Cys Ser Gly Ser Gly Asn
225                 230                 235                 240

Asn Gly Gly Gly Ser Asn Pro Ser Gly Gly Gln Thr Thr Thr Ala Lys
                245                 250                 255

Pro Thr Thr Thr Thr Ala Ala Thr Thr Thr Ser Ser Ala Ala Pro Thr
            260                 265                 270

Ser Ser Gln Gly Gly Ser Ser Gly Cys Thr Val Pro Gln Trp Gln Gln
        275                 280                 285
```

```
Cys Gly Gly Ile Ser Phe Thr Gly Cys Thr Thr Cys Ala Ala Gly Tyr
    290                 295                 300

Thr Cys Lys Tyr Leu Asn Asp Tyr Tyr Ser Gln Cys Gln
305                 310                 315


<210> SEQ ID NO 10
<211> LENGTH: 249
<212> TYPE: PRT
<213> ORGANISM: Thermoascus aurantiacus

<400> SEQUENCE: 10

Met Ser Phe Ser Lys Ile Ile Ala Thr Ala Gly Val Leu Ala Ser Ala
1               5                   10                  15

Ser Leu Val Ala Gly His Gly Phe Val Gln Asn Ile Val Ile Asp Gly
            20                  25                  30

Lys Tyr Tyr Gly Gly Tyr Leu Val Asn Gln Tyr Pro Tyr Met Ser Asn
        35                  40                  45

Pro Pro Glu Val Ile Ala Trp Ser Thr Thr Ala Thr Asp Leu Gly Phe
    50                  55                  60

Val Asp Gly Thr Gly Tyr Gln Thr Pro Asp Ile Ile Cys His Arg Gly
65                  70                  75                  80

Ala Lys Pro Gly Ala Leu Thr Ala Pro Val Ser Pro Gly Gly Thr Val
                85                  90                  95

Glu Leu Gln Trp Thr Pro Trp Pro Asp Ser His His Gly Pro Val Ile
            100                 105                 110

Asn Tyr Leu Ala Pro Cys Asn Gly Asp Cys Ser Thr Val Asp Lys Thr
        115                 120                 125

Gln Leu Glu Phe Phe Lys Ile Ala Glu Ser Gly Leu Ile Asn Asp Asp
    130                 135                 140

Asn Pro Pro Gly Ile Trp Ala Ser Asp Asn Leu Ile Ala Ala Asn Asn
145                 150                 155                 160

Ser Trp Thr Val Thr Ile Pro Thr Thr Ile Ala Pro Gly Asn Tyr Val
                165                 170                 175

Leu Arg His Glu Ile Ile Ala Leu His Ser Ala Gln Asn Gln Asp Gly
            180                 185                 190

Ala Gln Asn Tyr Pro Gln Cys Ile Asn Leu Gln Val Thr Gly Gly Gly
        195                 200                 205

Ser Asp Asn Pro Ala Gly Thr Leu Gly Thr Ala Leu Tyr His Asp Thr
    210                 215                 220

Asp Pro Gly Ile Leu Ile Asn Ile Tyr Gln Lys Leu Ser Ser Tyr Ile
225                 230                 235                 240

Ile Pro Gly Pro Pro Leu Tyr Thr Gly
                245


<210> SEQ ID NO 11
<211> LENGTH: 249
<212> TYPE: PRT
<213> ORGANISM: Trichoderma reesei

<400> SEQUENCE: 11

Met Lys Ser Cys Ala Ile Leu Ala Ala Leu Gly Cys Leu Ala Gly Ser
1               5                   10                  15

Val Leu Gly His Gly Gln Val Gln Asn Phe Thr Ile Asn Gly Gln Tyr
            20                  25                  30

Asn Gln Gly Phe Ile Leu Asp Tyr Tyr Tyr Gln Lys Gln Asn Thr Gly
        35                  40                  45
```

```
His Phe Pro Asn Val Ala Gly Trp Tyr Ala Glu Asp Leu Asp Leu Gly
    50                  55                  60

Phe Ile Ser Pro Asp Gln Tyr Thr Thr Pro Asp Ile Val Cys His Lys
65                  70                  75                  80

Asn Ala Ala Pro Gly Ala Ile Ser Ala Thr Ala Ala Ala Gly Ser Asn
                85                  90                  95

Ile Val Phe Gln Trp Gly Pro Gly Val Trp Pro His Pro Tyr Gly Pro
            100                 105                 110

Ile Val Thr Tyr Val Val Glu Cys Ser Gly Ser Cys Thr Thr Val Asn
        115                 120                 125

Lys Asn Asn Leu Arg Trp Val Lys Ile Gln Glu Ala Gly Ile Asn Tyr
    130                 135                 140

Asn Thr Gln Val Trp Ala Gln Gln Asp Leu Ile Asn Gln Gly Asn Lys
145                 150                 155                 160

Trp Thr Val Lys Ile Pro Ser Ser Leu Arg Pro Gly Asn Tyr Val Phe
                165                 170                 175

Arg His Glu Leu Leu Ala Ala His Gly Ala Ser Ser Ala Asn Gly Met
            180                 185                 190

Gln Asn Tyr Pro Gln Cys Val Asn Ile Ala Val Thr Gly Ser Gly Thr
        195                 200                 205

Lys Ala Leu Pro Ala Gly Thr Pro Ala Thr Gln Leu Tyr Lys Pro Thr
    210                 215                 220

Asp Pro Gly Ile Leu Phe Asn Pro Tyr Thr Thr Ile Thr Ser Tyr Thr
225                 230                 235                 240

Ile Pro Gly Pro Ala Leu Trp Gln Gly
                245


<210> SEQ ID NO 12
<211> LENGTH: 232
<212> TYPE: PRT
<213> ORGANISM: Myceliophthora thermophila

<400> SEQUENCE: 12

Met Lys Phe Thr Ser Ser Leu Ala Val Leu Ala Ala Ala Gly Ala Gln
1               5                   10                  15

Ala His Tyr Thr Phe Pro Arg Ala Gly Thr Gly Gly Ser Leu Ser Gly
            20                  25                  30

Glu Trp Glu Val Val Arg Met Thr Glu Asn His Tyr Ser His Gly Pro
        35                  40                  45

Val Thr Asp Val Thr Ser Pro Glu Met Thr Cys Tyr Gln Ser Gly Val
    50                  55                  60

Gln Gly Ala Pro Gln Thr Val Gln Val Lys Ala Gly Ser Gln Phe Thr
65                  70                  75                  80

Phe Ser Val Asp Pro Ser Ile Gly His Pro Gly Pro Leu Gln Phe Tyr
                85                  90                  95

Met Ala Lys Val Pro Ser Gly Gln Thr Ala Ala Thr Phe Asp Gly Thr
            100                 105                 110

Gly Ala Val Trp Phe Lys Ile Tyr Gln Asp Gly Pro Asn Gly Leu Gly
        115                 120                 125

Thr Asp Ser Ile Thr Trp Pro Ser Ala Gly Lys Thr Glu Val Ser Val
    130                 135                 140

Thr Ile Pro Ser Cys Ile Asp Asp Gly Glu Tyr Leu Leu Arg Val Glu
145                 150                 155                 160

His Ile Ala Leu His Ser Ala Ser Ser Val Gly Gly Ala Gln Phe Tyr
                165                 170                 175
```

```
Ile Ala Cys Ala Gln Leu Ser Val Thr Gly Gly Ser Gly Thr Leu Asn
            180                 185                 190

Thr Gly Ser Leu Val Ser Leu Pro Gly Ala Tyr Lys Ala Thr Asp Pro
        195                 200                 205

Gly Ile Leu Phe Gln Leu Tyr Trp Pro Ile Pro Thr Glu Tyr Ile Asn
    210                 215                 220

Pro Gly Pro Ala Pro Val Ser Cys
225                 230


<210> SEQ ID NO 13
<211> LENGTH: 235
<212> TYPE: PRT
<213> ORGANISM: Myceliophthora thermophila

<400> SEQUENCE: 13

Met Lys Ala Leu Ser Leu Leu Ala Ala Ala Ser Ala Val Ser Ala His
1               5                   10                  15

Thr Ile Phe Val Gln Leu Glu Ala Asp Gly Thr Arg Tyr Pro Val Ser
            20                  25                  30

Tyr Gly Ile Arg Asp Pro Ser Tyr Asp Gly Pro Ile Thr Asp Val Thr
        35                  40                  45

Ser Asn Asp Val Ala Cys Asn Gly Gly Pro Asn Pro Thr Thr Pro Ser
    50                  55                  60

Ser Asp Val Ile Thr Val Thr Ala Gly Thr Thr Val Lys Ala Ile Trp
65                  70                  75                  80

Arg His Thr Leu Gln Ser Gly Pro Asp Asp Val Met Asp Ala Ser His
                85                  90                  95

Lys Gly Pro Thr Leu Ala Tyr Leu Lys Lys Val Gly Asp Ala Thr Lys
            100                 105                 110

Asp Ser Gly Val Gly Gly Gly Trp Phe Lys Ile Gln Glu Asp Gly Tyr
        115                 120                 125

Asn Asn Gly Gln Trp Gly Thr Ser Thr Val Ile Ser Asn Gly Gly Glu
    130                 135                 140

His Tyr Ile Asp Ile Pro Ala Cys Ile Pro Glu Gly Gln Tyr Leu Leu
145                 150                 155                 160

Arg Ala Glu Met Ile Ala Leu His Ala Ala Gly Ser Pro Gly Gly Ala
                165                 170                 175

Gln Leu Tyr Met Glu Cys Ala Gln Ile Asn Ile Val Gly Gly Ser Gly
            180                 185                 190

Ser Val Pro Ser Ser Thr Val Ser Phe Pro Gly Ala Tyr Ser Pro Asn
        195                 200                 205

Asp Pro Gly Leu Leu Ile Asn Ile Tyr Ser Met Ser Pro Ser Ser Ser
    210                 215                 220

Tyr Thr Ile Pro Gly Pro Pro Val Phe Lys Cys
225                 230                 235


<210> SEQ ID NO 14
<211> LENGTH: 323
<212> TYPE: PRT
<213> ORGANISM: Myceliophthora thermophila

<400> SEQUENCE: 14

Met Lys Ser Phe Ala Leu Thr Thr Leu Ala Ala Leu Ala Gly Asn Ala
1               5                   10                  15

Ala Ala His Ala Thr Phe Gln Ala Leu Trp Val Asp Gly Val Asp Tyr
            20                  25                  30
```

```
Gly Ala Gln Cys Ala Arg Leu Pro Ala Ser Asn Ser Pro Val Thr Asp
        35                  40                  45

Val Thr Ser Asn Ala Ile Arg Cys Asn Ala Asn Pro Ser Pro Ala Arg
    50                  55                  60

Gly Lys Cys Pro Val Lys Ala Gly Ser Thr Val Thr Val Glu Met His
65                  70                  75                  80

Gln Gln Pro Gly Asp Arg Ser Cys Ser Ser Glu Ala Ile Gly Gly Ala
                85                  90                  95

His Tyr Gly Pro Val Met Val Tyr Met Ser Lys Val Ser Asp Ala Ala
            100                 105                 110

Ser Ala Asp Gly Ser Ser Gly Trp Phe Lys Val Phe Glu Asp Gly Trp
        115                 120                 125

Ala Lys Asn Pro Ser Gly Gly Ser Gly Asp Asp Asp Tyr Trp Gly Thr
    130                 135                 140

Lys Asp Leu Asn Ser Cys Cys Gly Lys Met Asn Val Lys Ile Pro Ala
145                 150                 155                 160

Asp Leu Pro Ser Gly Asp Tyr Leu Leu Arg Ala Glu Ala Leu Ala Leu
                165                 170                 175

His Thr Ala Gly Ser Ala Gly Gly Ala Gln Phe Tyr Met Thr Cys Tyr
            180                 185                 190

Gln Leu Thr Val Thr Gly Ser Gly Ser Ala Ser Pro Pro Thr Val Ser
        195                 200                 205

Phe Pro Gly Ala Tyr Lys Ala Thr Asp Pro Gly Ile Leu Val Asn Ile
    210                 215                 220

His Ala Pro Leu Ser Gly Tyr Thr Val Pro Gly Pro Ala Val Tyr Ser
225                 230                 235                 240

Gly Gly Ser Thr Lys Lys Ala Gly Ser Ala Cys Thr Gly Cys Glu Ser
                245                 250                 255

Thr Cys Ala Val Gly Ser Gly Pro Thr Ala Thr Val Ser Gln Ser Pro
            260                 265                 270

Gly Ser Thr Ala Thr Ser Ala Pro Gly Gly Gly Gly Gly Cys Thr Val
        275                 280                 285

Gln Lys Tyr Gln Gln Cys Gly Gly Glu Gly Tyr Thr Gly Cys Thr Asn
    290                 295                 300

Cys Ala Ser Gly Ser Thr Cys Ser Ala Val Ser Pro Pro Tyr Tyr Ser
305                 310                 315                 320

Gln Cys Val


<210> SEQ ID NO 15
<211> LENGTH: 310
<212> TYPE: PRT
<213> ORGANISM: Myceliophthora thermophila

<400> SEQUENCE: 15

Met Lys Pro Phe Ser Leu Val Ala Leu Ala Thr Ala Val Ser Gly His
1               5                   10                  15

Ala Ile Phe Gln Arg Val Ser Val Asn Gly Gln Asp Gln Gly Gln Leu
            20                  25                  30

Lys Gly Val Arg Ala Pro Ser Ser Asn Ser Pro Ile Gln Asn Val Asn
        35                  40                  45

Asp Ala Asn Met Ala Cys Asn Ala Asn Ile Val Tyr His Asp Ser Thr
    50                  55                  60

Ile Ile Lys Val Pro Ala Gly Ala Arg Val Gly Ala Trp Trp Gln His
65                  70                  75                  80
```

```
Val Ile Gly Gly Pro Gln Gly Ala Asn Asp Pro Asp Asn Pro Ile Ala
                85                  90                  95

Ala Ser His Lys Gly Pro Ile Gln Val Tyr Leu Ala Lys Val Asp Asn
            100                 105                 110

Ala Ala Thr Ala Ser Pro Ser Gly Leu Arg Trp Phe Lys Val Ala Glu
        115                 120                 125

Arg Gly Leu Asn Asn Gly Val Trp Ala Val Asp Glu Leu Ile Ala Asn
    130                 135                 140

Asn Gly Trp His Tyr Phe Asp Leu Pro Ser Cys Val Ala Pro Gly Gln
145                 150                 155                 160

Tyr Leu Met Arg Val Glu Leu Leu Ala Leu His Ser Ala Ser Ser Pro
                165                 170                 175

Gly Gly Ala Gln Phe Tyr Met Gly Cys Ala Gln Ile Glu Val Thr Gly
            180                 185                 190

Ser Gly Thr Asn Ser Gly Ser Asp Phe Val Ser Phe Pro Gly Ala Tyr
        195                 200                 205

Ser Ala Asn Asp Pro Gly Ile Leu Leu Ser Ile Tyr Asp Ser Ser Gly
    210                 215                 220

Lys Pro Thr Asn Gly Gly Arg Ser Tyr Pro Ile Pro Gly Pro Arg Pro
225                 230                 235                 240

Ile Ser Cys Ser Gly Ser Gly Asp Gly Gly Asn Asn Gly Gly Gly Gly
                245                 250                 255

Asp Asp Asn Asn Asn Asn Asn Gly Gly Gly Asn Asn Gly Gly Gly Gly
            260                 265                 270

Gly Gly Ser Val Pro Leu Tyr Gly Gln Cys Gly Gly Ile Gly Tyr Thr
        275                 280                 285

Gly Pro Thr Thr Cys Ala Gln Gly Thr Cys Lys Val Ser Asn Glu Tyr
    290                 295                 300

Tyr Ser Gln Cys Leu Pro
305                 310


<210> SEQ ID NO 16
<211> LENGTH: 246
<212> TYPE: PRT
<213> ORGANISM: Myceliophthora thermophila

<400> SEQUENCE: 16

Met Lys Leu Ser Leu Phe Ser Val Leu Ala Thr Ala Leu Thr Val Glu
1               5                   10                  15

Gly His Ala Ile Phe Gln Lys Val Ser Val Asn Gly Ala Asp Gln Gly
            20                  25                  30

Ser Leu Thr Gly Leu Arg Ala Pro Asn Asn Asn Asn Pro Val Gln Asp
        35                  40                  45

Val Asn Ser Gln Asp Met Ile Cys Gly Gln Ser Gly Ser Thr Ser Asn
    50                  55                  60

Thr Ile Ile Glu Val Lys Ala Gly Asp Arg Ile Gly Ala Trp Tyr Gln
65                  70                  75                  80

His Val Ile Gly Gly Ala Gln Phe Pro Asn Asp Pro Asp Asn Pro Ile
                85                  90                  95

Ala Lys Ser His Lys Gly Pro Val Met Ala Tyr Leu Ala Lys Val Asp
            100                 105                 110

Asn Ala Ala Thr Ala Ser Lys Thr Gly Leu Lys Trp Phe Lys Ile Trp
        115                 120                 125

Glu Asp Thr Phe Asn Pro Ser Thr Lys Thr Trp Gly Val Asp Asn Leu
```

```
    130                 135                 140

Ile Asn Asn Asn Gly Trp Val Tyr Phe Asn Leu Pro Gln Cys Ile Ala
145                 150                 155                 160

Asp Gly Asn Tyr Leu Leu Arg Val Glu Val Leu Ala Leu His Ser Ala
                165                 170                 175

Tyr Ser Gln Gly Gln Ala Gln Phe Tyr Gln Ser Cys Ala Gln Ile Asn
            180                 185                 190

Val Ser Gly Gly Gly Ser Phe Thr Pro Pro Ser Thr Val Ser Phe Pro
        195                 200                 205

Gly Ala Tyr Ser Ala Ser Asp Pro Gly Ile Leu Ile Asn Ile Tyr Gly
    210                 215                 220

Ala Thr Gly Gln Pro Asp Asn Asn Gly Gln Pro Tyr Thr Ala Pro Gly
225                 230                 235                 240

Pro Ala Pro Ile Ser Cys
                245


<210> SEQ ID NO 17
<211> LENGTH: 354
<212> TYPE: PRT
<213> ORGANISM: Thermoascus aurantiacus

<400> SEQUENCE: 17

Met Ser Phe Ser Lys Ile Ala Ala Ile Thr Gly Ala Ile Thr Tyr Ala
1               5                   10                  15

Ser Leu Ala Ala Ala His Gly Tyr Val Thr Gly Ile Val Ala Asp Gly
            20                  25                  30

Thr Tyr Tyr Gly Gly Tyr Ile Val Thr Gln Tyr Pro Tyr Met Ser Thr
        35                  40                  45

Pro Pro Asp Val Ile Ala Trp Ser Thr Lys Ala Thr Asp Leu Gly Phe
    50                  55                  60

Val Asp Pro Ser Ser Tyr Ala Ser Ser Asp Ile Ile Cys His Lys Gly
65                  70                  75                  80

Ala Glu Pro Gly Ala Leu Ser Ala Lys Val Ala Ala Gly Gly Thr Val
                85                  90                  95

Glu Leu Gln Trp Thr Asp Trp Pro Glu Ser His Lys Gly Pro Val Ile
            100                 105                 110

Asp Tyr Leu Ala Ala Cys Asn Gly Asp Cys Ser Thr Val Asp Lys Thr
        115                 120                 125

Lys Leu Glu Phe Phe Lys Ile Asp Glu Ser Gly Leu Ile Asp Gly Ser
    130                 135                 140

Ser Ala Pro Gly Thr Trp Ala Ser Asp Asn Leu Ile Ala Asn Asn Asn
145                 150                 155                 160

Ser Trp Thr Val Thr Ile Pro Ser Thr Ile Ala Pro Gly Asn Tyr Val
                165                 170                 175

Leu Arg His Glu Ile Ile Ala Leu His Ser Ala Gly Asn Thr Asn Gly
            180                 185                 190

Ala Gln Asn Tyr Pro Gln Cys Ile Asn Leu Glu Val Thr Gly Ser Gly
        195                 200                 205

Thr Asp Thr Pro Ala Gly Thr Leu Gly Thr Glu Leu Tyr Lys Ala Thr
    210                 215                 220

Asp Pro Gly Ile Leu Val Asn Ile Tyr Gln Thr Leu Thr Ser Tyr Asp
225                 230                 235                 240

Ile Pro Gly Pro Ala Leu Tyr Thr Gly Gly Ser Ser Gly Ser Ser Gly
                245                 250                 255
```

```
Ser Ser Asn Thr Ala Lys Ala Thr Thr Ser Thr Ala Ser Ser Ser Ile
            260                 265                 270

Val Thr Pro Thr Pro Val Asn Asn Pro Thr Val Thr Gln Thr Ala Val
        275                 280                 285

Val Asp Val Thr Gln Thr Val Ser Gln Asn Ala Ala Val Ala Thr Thr
    290                 295                 300

Thr Pro Ala Ser Thr Ala Val Ala Thr Ala Val Pro Thr Gly Thr Thr
305                 310                 315                 320

Phe Ser Phe Asp Ser Met Thr Ser Asp Glu Phe Val Ser Leu Met Arg
                325                 330                 335

Ala Thr Val Asn Trp Leu Leu Ser Asn Lys Lys His Ala Arg Asp Leu
            340                 345                 350

Ser Tyr


<210> SEQ ID NO 18
<211> LENGTH: 250
<212> TYPE: PRT
<213> ORGANISM: Aspergillus fumigatus

<400> SEQUENCE: 18

Met Thr Leu Ser Lys Ile Thr Ser Ile Ala Gly Leu Leu Ala Ser Ala
1               5                   10                  15

Ser Leu Val Ala Gly His Gly Phe Val Ser Gly Ile Val Ala Asp Gly
            20                  25                  30

Lys Tyr Tyr Gly Gly Tyr Leu Val Asn Gln Tyr Pro Tyr Met Ser Asn
        35                  40                  45

Pro Pro Asp Thr Ile Ala Trp Ser Thr Thr Ala Thr Asp Leu Gly Phe
    50                  55                  60

Val Asp Gly Thr Gly Tyr Gln Ser Pro Asp Ile Ile Cys His Arg Asp
65                  70                  75                  80

Ala Lys Asn Gly Lys Leu Thr Ala Thr Val Ala Ala Gly Ser Gln Ile
                85                  90                  95

Glu Phe Gln Trp Thr Thr Trp Pro Glu Ser His His Gly Pro Leu Ile
            100                 105                 110

Thr Tyr Leu Ala Pro Cys Asn Gly Asp Cys Ala Thr Val Asp Lys Thr
        115                 120                 125

Thr Leu Lys Phe Val Lys Ile Ala Ala Gln Gly Leu Ile Asp Gly Ser
    130                 135                 140

Asn Pro Pro Gly Val Trp Ala Asp Asp Glu Met Ile Ala Asn Asn Asn
145                 150                 155                 160

Thr Ala Thr Val Thr Ile Pro Ala Ser Tyr Ala Pro Gly Asn Tyr Val
                165                 170                 175

Leu Arg His Glu Ile Ile Ala Leu His Ser Ala Gly Asn Leu Asn Gly
            180                 185                 190

Ala Gln Asn Tyr Pro Gln Cys Phe Asn Ile Gln Ile Thr Gly Gly Gly
        195                 200                 205

Ser Ala Gln Gly Ser Gly Thr Ala Gly Thr Ser Leu Tyr Lys Asn Thr
    210                 215                 220

Asp Pro Gly Ile Lys Phe Asp Ile Tyr Ser Asp Leu Ser Gly Gly Tyr
225                 230                 235                 240

Pro Ile Pro Gly Pro Ala Leu Phe Asn Ala
                245                 250


<210> SEQ ID NO 19
<211> LENGTH: 322
```

<212> TYPE: PRT
<213> ORGANISM: Penicillium pinophilum

<400> SEQUENCE: 19

Met Pro Ser Thr Lys Val Ala Ala Leu Ser Ala Val Leu Ala Leu Ala
1 5 10 15

Ser Thr Val Ala Gly His Gly Phe Val Gln Asn Ile Val Ile Asp Gly
20 25 30

Lys Ser Tyr Ser Gly Tyr Leu Val Asn Gln Phe Pro Tyr Glu Ser Asn
35 40 45

Pro Pro Ala Val Ile Gly Trp Ala Thr Thr Ala Thr Asp Leu Gly Phe
50 55 60

Val Ala Pro Ser Glu Tyr Thr Asn Ala Asp Ile Ile Cys His Lys Asn
65 70 75 80

Ala Thr Pro Gly Ala Leu Ser Ala Pro Val Ala Ala Gly Gly Thr Val
85 90 95

Glu Leu Gln Trp Thr Thr Trp Pro Asp Ser His His Gly Pro Val Ile
100 105 110

Ser Tyr Leu Ala Asn Cys Asn Gly Asn Cys Ser Thr Val Asp Lys Thr
115 120 125

Lys Leu Asp Phe Val Lys Ile Asp Gln Gly Gly Leu Ile Asp Asp Thr
130 135 140

Thr Pro Pro Gly Thr Trp Ala Ser Asp Lys Leu Ile Ala Ala Asn Asn
145 150 155 160

Ser Trp Thr Val Thr Ile Pro Ser Thr Ile Ala Pro Gly Asn Tyr Val
165 170 175

Leu Arg His Glu Ile Ile Ala Leu His Ser Ala Gly Asn Ala Asp Gly
180 185 190

Ala Gln Asn Tyr Pro Gln Cys Ile Asn Leu Glu Ile Thr Gly Ser Gly
195 200 205

Thr Ala Ala Pro Ser Gly Thr Ala Gly Glu Lys Leu Tyr Thr Ser Thr
210 215 220

Asp Pro Gly Ile Leu Val Asn Ile Tyr Gln Ser Leu Ser Thr Tyr Val
225 230 235 240

Ile Pro Gly Pro Thr Leu Trp Ser Gly Ala Ala Asn Gly Ala Val Ala
245 250 255

Thr Gly Ser Ala Thr Ala Val Ala Thr Thr Ala Thr Ala Ser Ala Thr
260 265 270

Ala Thr Pro Thr Thr Leu Val Thr Ser Val Ala Pro Ala Ser Ser Thr
275 280 285

Phe Ala Thr Ala Val Val Thr Thr Val Ala Pro Ala Val Thr Asp Val
290 295 300

Val Thr Val Thr Asp Val Val Thr Val Thr Thr Val Ile Thr Thr Thr
305 310 315 320

Val Leu

<210> SEQ ID NO 20
<211> LENGTH: 444
<212> TYPE: PRT
<213> ORGANISM: Thermoascus sp.

<400> SEQUENCE: 20

Met Leu Ser Phe Ala Ser Ala Lys Ser Ala Val Leu Thr Thr Leu Leu
1 5 10 15

Leu Leu Gly Ser Ala Gln Ala His Thr Leu Met Thr Thr Leu Phe Val

```
            20                  25                  30

Asp Gly Val Asn Gln Gly Asp Gly Val Cys Ile Arg Met Asn Asn Asn
        35                  40                  45

Gly Ser Thr Ala Asn Thr Tyr Ile Gln Pro Val Thr Ser Lys Asp Ile
    50                  55                  60

Ala Cys Gly Ile Gln Gly Glu Ile Gly Ala Ala Arg Val Cys Pro Ala
65                  70                  75                  80

Lys Ala Ser Ser Thr Leu Thr Phe Gln Phe Arg Glu Gln Pro Ser Asn
                85                  90                  95

Pro Asn Ser Ala Pro Leu Asp Pro Ser His Lys Gly Pro Ala Ala Val
            100                 105                 110

Tyr Leu Lys Lys Val Asp Ser Ala Ile Ala Ser Asn Asn Ala Ala Gly
        115                 120                 125

Asp Gly Trp Phe Lys Ile Trp Glu Ser Val Tyr Asp Glu Ser Thr Gly
    130                 135                 140

Lys Trp Gly Thr Thr Lys Met Ile Glu Asn Asn Gly His Ile Ser Val
145                 150                 155                 160

Lys Val Pro Asp Asp Ile Glu Gly Gly Tyr Tyr Leu Ala Arg Thr Glu
                165                 170                 175

Leu Leu Ala Leu His Ala Ala Asn Glu Gly Asp Pro Gln Phe Tyr Val
            180                 185                 190

Gly Cys Ala Gln Leu Phe Ile Asp Ser Ala Gly Thr Ala Lys Pro Pro
        195                 200                 205

Thr Val Ser Ile Gly Glu Gly Thr Tyr Asp Leu Ser Met Pro Ala Met
    210                 215                 220

Thr Tyr Asn Ile Tyr Gln Thr Pro Leu Ala Leu Pro Tyr Pro Met Tyr
225                 230                 235                 240

Gly Pro Pro Val Tyr Thr Pro Gly Ser Gly Ser Gly Ser Gly Ser Gly
                245                 250                 255

Ser Gly Ser Ala Ser Ala Thr Arg Ser Ser Ala Ile Pro Thr Ala Thr
            260                 265                 270

Ala Val Thr Asp Cys Ser Ser Glu Glu Asp Arg Glu Asp Ser Val Met
        275                 280                 285

Ala Thr Gly Val Pro Val Ala Arg Ser Thr Leu Arg Thr Trp Val Asp
    290                 295                 300

Arg Leu Ser Trp His Gly Lys Ala Arg Glu Asn Val Lys Pro Ala Ala
305                 310                 315                 320

Arg Arg Ser Ala Leu Val Gln Thr Glu Gly Leu Lys Pro Glu Gly Cys
                325                 330                 335

Ile Phe Val Asn Gly Asn Trp Cys Gly Phe Glu Val Pro Asp Tyr Asn
            340                 345                 350

Asp Ala Glu Ser Cys Trp Ala Ala Ser Asp Asn Cys Trp Lys Gln Ser
        355                 360                 365

Asp Ser Cys Trp Asn Gln Thr Gln Pro Thr Gly Tyr Asn Asn Cys Gln
    370                 375                 380

Ile Trp Gln Asp Gln Lys Cys Lys Pro Ile Gln Asp Ser Cys Ser Gln
385                 390                 395                 400

Ser Asn Pro Thr Gly Pro Pro Asn Lys Gly Lys Asp Ile Thr Pro Thr
                405                 410                 415

Trp Pro Pro Leu Glu Gly Ser Met Lys Thr Phe Thr Lys Arg Thr Val
            420                 425                 430

Ser Tyr Arg Asp Trp Ile Met Lys Arg Lys Gly Ala
        435                 440
```

<210> SEQ ID NO 21
<211> LENGTH: 253
<212> TYPE: PRT
<213> ORGANISM: Penicillium sp.

<400> SEQUENCE: 21

Met Leu Ser Ser Thr Thr Arg Thr Leu Ala Phe Thr Gly Leu Ala Gly
1 5 10 15

Leu Leu Ser Ala Pro Leu Val Lys Ala His Gly Phe Val Gln Gly Ile
20 25 30

Val Ile Gly Asp Gln Phe Tyr Ser Gly Tyr Ile Val Asn Ser Phe Pro
35 40 45

Tyr Glu Ser Asn Pro Pro Pro Val Ile Gly Trp Ala Thr Thr Ala Thr
50 55 60

Asp Leu Gly Phe Val Asp Gly Thr Gly Tyr Gln Gly Pro Asp Ile Ile
65 70 75 80

Cys His Arg Asn Ala Thr Pro Ala Pro Leu Thr Ala Pro Val Ala Ala
85 90 95

Gly Gly Thr Val Glu Leu Gln Trp Thr Pro Trp Pro Asp Ser His His
100 105 110

Gly Pro Val Ile Thr Tyr Leu Ala Pro Cys Asn Gly Asn Cys Ser Thr
115 120 125

Val Asp Lys Thr Thr Leu Glu Phe Phe Lys Ile Asp Gln Gln Gly Leu
130 135 140

Ile Asp Asp Thr Ser Pro Pro Gly Thr Trp Ala Ser Asp Asn Leu Ile
145 150 155 160

Ala Asn Asn Asn Ser Trp Thr Val Thr Ile Pro Asn Ser Val Ala Pro
165 170 175

Gly Asn Tyr Val Leu Arg His Glu Ile Ile Ala Leu His Ser Ala Asn
180 185 190

Asn Lys Asp Gly Ala Gln Asn Tyr Pro Gln Cys Ile Asn Ile Glu Val
195 200 205

Thr Gly Gly Gly Ser Asp Ala Pro Glu Gly Thr Leu Gly Glu Asp Leu
210 215 220

Tyr His Asp Thr Asp Pro Gly Ile Leu Val Asp Ile Tyr Glu Pro Ile
225 230 235 240

Ala Thr Tyr Thr Ile Pro Gly Pro Pro Glu Pro Thr Phe
245 250

<210> SEQ ID NO 22
<211> LENGTH: 223
<212> TYPE: PRT
<213> ORGANISM: Thielavia terrestris

<400> SEQUENCE: 22

Met Lys Leu Ser Ser Gln Leu Ala Ala Leu Thr Leu Ala Ala Ala Ser
1 5 10 15

Val Ser Gly His Tyr Ile Phe Glu Gln Ile Ala His Gly Gly Thr Lys
20 25 30

Phe Pro Pro Tyr Glu Tyr Ile Arg Arg Asn Thr Asn Tyr Asn Ser Pro
35 40 45

Val Thr Ser Leu Ser Ser Asn Asp Leu Arg Cys Asn Val Gly Gly Glu
50 55 60

Thr Ala Gly Asn Thr Thr Val Leu Asp Val Lys Ala Gly Asp Ser Phe
65 70 75 80

```
Thr Phe Tyr Ser Asp Val Ala Val Tyr His Gln Gly Pro Ile Ser Leu
                85                  90                  95

Tyr Met Ser Lys Ala Pro Gly Ser Val Val Asp Tyr Asp Gly Ser Gly
            100                 105                 110

Asp Trp Phe Lys Ile His Asp Trp Gly Pro Thr Phe Ser Asn Gly Gln
        115                 120                 125

Ala Ser Trp Pro Leu Arg Asp Asn Tyr Gln Tyr Asn Ile Pro Thr Cys
    130                 135                 140

Ile Pro Asn Gly Glu Tyr Leu Leu Arg Ile Gln Ser Leu Ala Ile His
145                 150                 155                 160

Asn Pro Gly Ala Thr Pro Gln Phe Tyr Ile Ser Cys Ala Gln Val Arg
                165                 170                 175

Val Ser Gly Gly Gly Ser Ala Ser Pro Ser Pro Thr Ala Lys Ile Pro
            180                 185                 190

Gly Ala Phe Lys Ala Thr Asp Pro Gly Tyr Thr Ala Asn Ile Tyr Asn
        195                 200                 205

Asn Phe His Ser Tyr Thr Val Pro Gly Pro Ala Val Phe Gln Cys
    210                 215                 220


<210> SEQ ID NO 23
<211> LENGTH: 246
<212> TYPE: PRT
<213> ORGANISM: Thielavia terrestris

<400> SEQUENCE: 23

Met Lys Phe Ser Leu Val Ser Leu Leu Ala Tyr Gly Leu Ser Val Glu
1               5                   10                  15

Ala His Ser Ile Phe Gln Arg Val Ser Val Asn Gly Gln Asp Gln Gly
            20                  25                  30

Leu Leu Thr Gly Leu Arg Ala Pro Ser Asn Asn Asn Pro Val Gln Asp
        35                  40                  45

Val Asn Ser Gln Asn Met Ile Cys Gly Gln Ser Gly Ser Lys Ser Gln
    50                  55                  60

Thr Val Ile Asn Val Lys Ala Gly Asp Arg Ile Gly Ser Leu Trp Gln
65                  70                  75                  80

His Val Ile Gly Gly Ala Gln Phe Ser Gly Asp Pro Asp Asn Pro Ile
                85                  90                  95

Ala His Ser His Lys Gly Pro Val Met Ala Tyr Leu Ala Lys Val Asp
            100                 105                 110

Asn Ala Ala Ser Ala Ser Gln Thr Gly Leu Lys Trp Phe Lys Ile Trp
        115                 120                 125

Gln Asp Gly Phe Asp Thr Ser Ser Lys Thr Trp Gly Val Asp Asn Leu
    130                 135                 140

Ile Lys Asn Asn Gly Trp Val Tyr Phe His Leu Pro Gln Cys Leu Ala
145                 150                 155                 160

Pro Gly Gln Tyr Leu Leu Arg Val Glu Val Leu Ala Leu His Ser Ala
                165                 170                 175

Tyr Gln Gln Gly Gln Ala Gln Phe Tyr Gln Ser Cys Ala Gln Ile Asn
            180                 185                 190

Val Ser Gly Ser Gly Ser Phe Ser Pro Ser Gln Thr Val Ser Ile Pro
        195                 200                 205

Gly Val Tyr Ser Ala Thr Asp Pro Ser Ile Leu Ile Asn Ile Tyr Gly
    210                 215                 220

Ser Thr Gly Gln Pro Asp Asn Gly Gly Lys Ala Tyr Asn Pro Pro Gly
```

225 230 235 240

Pro Ala Pro Ile Ser Cys
245

<210> SEQ ID NO 24
<211> LENGTH: 334
<212> TYPE: PRT
<213> ORGANISM: Thielavia terrestris

<400> SEQUENCE: 24

Met Arg Thr Thr Phe Ala Ala Ala Leu Ala Ala Phe Ala Ala Gln Glu
1 5 10 15

Val Ala Gly His Ala Ile Phe Gln Gln Leu Trp His Gly Ser Ser Cys
20 25 30

Val Arg Met Pro Leu Ser Asn Ser Pro Val Thr Asn Val Gly Ser Arg
35 40 45

Asp Met Ile Cys Asn Ala Gly Thr Arg Pro Val Ser Gly Lys Cys Pro
50 55 60

Val Lys Ala Gly Gly Thr Val Thr Val Glu Met His Gln Gln Pro Gly
65 70 75 80

Asp Arg Ser Cys Asn Asn Glu Ala Ile Gly Gly Ala His Trp Gly Pro
85 90 95

Val Gln Val Tyr Leu Ser Lys Val Glu Asp Ala Ser Thr Ala Asp Gly
100 105 110

Ser Thr Gly Trp Phe Lys Ile Phe Ala Asp Thr Trp Ser Lys Lys Ala
115 120 125

Gly Ser Ser Val Gly Asp Asp Asp Asn Trp Gly Thr Arg Asp Leu Asn
130 135 140

Ala Cys Cys Gly Lys Met Gln Val Lys Ile Pro Ala Asp Ile Pro Ser
145 150 155 160

Gly Asp Tyr Leu Leu Arg Ala Glu Ala Leu Ala Leu His Thr Ala Gly
165 170 175

Gln Val Gly Gly Ala Gln Phe Tyr Met Ser Cys Tyr Gln Ile Thr Val
180 185 190

Ser Gly Gly Gly Ser Ala Ser Pro Ala Thr Val Lys Phe Pro Gly Ala
195 200 205

Tyr Ser Ala Asn Asp Pro Gly Ile His Ile Asn Ile His Ala Ala Val
210 215 220

Ser Asn Tyr Val Ala Pro Gly Pro Ala Val Tyr Ser Gly Gly Thr Thr
225 230 235 240

Lys Val Ala Gly Ser Gly Cys Gln Gly Cys Glu Asn Thr Cys Lys Val
245 250 255

Gly Ser Ser Pro Thr Ala Thr Ala Pro Ser Gly Lys Ser Gly Ala Gly
260 265 270

Ser Asp Gly Gly Ala Gly Thr Asp Gly Gly Ser Ser Ser Ser Ser Pro
275 280 285

Asp Thr Gly Ser Ala Cys Ser Val Gln Ala Tyr Gly Gln Cys Gly Gly
290 295 300

Asn Gly Tyr Ser Gly Cys Thr Gln Cys Ala Pro Gly Tyr Thr Cys Lys
305 310 315 320

Ala Val Ser Pro Pro Tyr Tyr Ser Gln Cys Ala Pro Ser Ser
325 330

<210> SEQ ID NO 25
<211> LENGTH: 227

<212> TYPE: PRT
<213> ORGANISM: Thielavia terrestris

<400> SEQUENCE: 25

Met Lys Leu Ser Val Ala Ile Ala Val Leu Ala Ser Ala Leu Ala Glu
1 5 10 15

Ala His Tyr Thr Phe Pro Ser Ile Gly Asn Thr Ala Asp Trp Gln Tyr
20 25 30

Val Arg Ile Thr Thr Asn Tyr Gln Ser Asn Gly Pro Val Thr Asp Val
35 40 45

Thr Ser Asp Gln Ile Arg Cys Tyr Glu Arg Asn Pro Gly Thr Gly Ala
50 55 60

Gln Gly Ile Tyr Asn Val Thr Ala Gly Gln Thr Ile Asn Tyr Asn Ala
65 70 75 80

Lys Ala Ser Ile Ser His Pro Gly Pro Met Ser Phe Tyr Ile Ala Lys
85 90 95

Val Pro Ala Gly Gln Thr Ala Ala Thr Trp Asp Gly Lys Gly Ala Val
100 105 110

Trp Thr Lys Ile Tyr Gln Asp Met Pro Lys Phe Gly Ser Ser Leu Thr
115 120 125

Trp Pro Thr Met Gly Ala Lys Ser Val Pro Val Thr Ile Pro Arg Cys
130 135 140

Leu Gln Asn Gly Asp Tyr Leu Leu Arg Ala Glu His Ile Ala Leu His
145 150 155 160

Ser Ala Ser Ser Val Gly Gly Ala Gln Phe Tyr Leu Ser Cys Ala Gln
165 170 175

Leu Thr Val Ser Gly Gly Ser Gly Thr Trp Asn Pro Lys Asn Arg Val
180 185 190

Ser Phe Pro Gly Ala Tyr Lys Ala Thr Asp Pro Gly Ile Leu Ile Asn
195 200 205

Ile Tyr Tyr Pro Val Pro Thr Ser Tyr Ser Pro Pro Gly Pro Pro Ala
210 215 220

Glu Thr Cys
225

<210> SEQ ID NO 26
<211> LENGTH: 368
<212> TYPE: PRT
<213> ORGANISM: Thielavia terrestris

<400> SEQUENCE: 26

Met Pro Ser Phe Ala Ser Lys Thr Leu Leu Ser Thr Leu Ala Gly Ala
1 5 10 15

Ala Ser Val Ala Ala His Gly His Val Ser Asn Ile Val Ile Asn Gly
20 25 30

Val Ser Tyr Gln Gly Tyr Asp Pro Thr Ser Phe Pro Tyr Met Gln Asn
35 40 45

Pro Pro Ile Val Val Gly Trp Thr Ala Ala Asp Thr Asp Asn Gly Phe
50 55 60

Val Ala Pro Asp Ala Phe Ala Ser Gly Asp Ile Ile Cys His Lys Asn
65 70 75 80

Ala Thr Asn Ala Lys Gly His Ala Val Val Ala Ala Gly Asp Lys Ile
85 90 95

Phe Ile Gln Trp Asn Thr Trp Pro Glu Ser His His Gly Pro Val Ile
100 105 110

```
Asp Tyr Leu Ala Ser Cys Gly Ser Ala Ser Cys Glu Thr Val Asp Lys
        115                 120                 125

Thr Lys Leu Glu Phe Phe Lys Ile Asp Glu Val Gly Leu Val Asp Gly
    130                 135                 140

Ser Ser Ala Pro Gly Val Trp Gly Ser Asp Gln Leu Ile Ala Asn Asn
145                 150                 155                 160

Asn Ser Trp Leu Val Glu Ile Pro Pro Thr Ile Ala Pro Gly Asn Tyr
                165                 170                 175

Val Leu Arg His Glu Ile Ile Ala Leu His Ser Ala Glu Asn Ala Asp
            180                 185                 190

Gly Ala Gln Asn Tyr Pro Gln Cys Phe Asn Leu Gln Ile Thr Gly Thr
        195                 200                 205

Gly Thr Ala Thr Pro Ser Gly Val Pro Gly Thr Ser Leu Tyr Thr Pro
    210                 215                 220

Thr Asp Pro Gly Ile Leu Val Asn Ile Tyr Ser Ala Pro Ile Thr Tyr
225                 230                 235                 240

Thr Val Pro Gly Pro Ala Leu Ile Ser Gly Ala Val Ser Ile Ala Gln
                245                 250                 255

Ser Ser Ser Ala Ile Thr Ala Ser Gly Thr Ala Leu Thr Gly Ser Ala
            260                 265                 270

Thr Ala Pro Ala Ala Ala Ala Ala Thr Thr Thr Ser Thr Thr Asn Ala
        275                 280                 285

Ala Ala Ala Ala Thr Ser Ala Ala Ala Ala Ala Gly Thr Ser Thr Thr
    290                 295                 300

Thr Thr Ser Ala Ala Ala Val Val Gln Thr Ser Ser Ser Ser Ser Ser
305                 310                 315                 320

Ala Pro Ser Ser Ala Ala Ala Ala Ala Thr Thr Thr Ala Ala Ala Ser
                325                 330                 335

Ala Arg Pro Thr Gly Cys Ser Ser Gly Arg Ser Arg Lys Gln Pro Arg
            340                 345                 350

Arg His Ala Arg Asp Met Val Val Ala Arg Gly Ala Glu Glu Ala Asn
        355                 360                 365


<210> SEQ ID NO 27
<211> LENGTH: 330
<212> TYPE: PRT
<213> ORGANISM: Thielavia terrestris

<400> SEQUENCE: 27

Met Pro Pro Ala Leu Pro Gln Leu Leu Thr Thr Val Leu Thr Ala Leu
1               5                   10                  15

Thr Leu Gly Ser Thr Ala Leu Ala His Ser His Leu Ala Tyr Ile Ile
            20                  25                  30

Val Asn Gly Lys Leu Tyr Gln Gly Phe Asp Pro Arg Pro His Gln Ala
        35                  40                  45

Asn Tyr Pro Ser Arg Val Gly Trp Ser Thr Gly Ala Val Asp Asp Gly
    50                  55                  60

Phe Val Thr Pro Ala Asn Tyr Ser Thr Pro Asp Ile Ile Cys His Ile
65                  70                  75                  80

Ala Gly Thr Ser Pro Ala Gly His Ala Pro Val Arg Pro Gly Asp Arg
                85                  90                  95

Ile His Val Gln Trp Asn Gly Trp Pro Val Gly His Ile Gly Pro Val
            100                 105                 110

Leu Ser Tyr Leu Ala Arg Cys Glu Ser Asp Thr Gly Cys Thr Gly Gln
        115                 120                 125
```

```
Asn Lys Thr Ala Leu Arg Trp Thr Lys Ile Asp Asp Ser Ser Pro Thr
    130                 135                 140

Met Gln Asn Val Ala Gly Ala Gly Thr Gln Gly Glu Gly Thr Pro Gly
145                 150                 155                 160

Lys Arg Trp Ala Thr Asp Val Leu Ile Ala Ala Asn Asn Ser Trp Gln
                165                 170                 175

Val Ala Val Pro Ala Gly Leu Pro Thr Gly Ala Tyr Val Leu Arg Asn
            180                 185                 190

Glu Ile Ile Ala Leu His Tyr Ala Ala Arg Lys Asn Gly Ala Gln Asn
        195                 200                 205

Tyr Pro Leu Cys Met Asn Leu Trp Val Asp Ala Ser Gly Asp Asn Ser
    210                 215                 220

Ser Val Ala Ala Thr Thr Ala Ala Val Thr Ala Gly Gly Leu Gln Met
225                 230                 235                 240

Asp Ala Tyr Asp Ala Arg Gly Phe Tyr Lys Glu Asn Asp Pro Gly Val
                245                 250                 255

Leu Val Asn Val Thr Ala Ala Leu Ser Ser Tyr Val Val Pro Gly Pro
            260                 265                 270

Thr Val Ala Ala Gly Ala Thr Pro Val Pro Tyr Ala Gln Gln Ser Pro
        275                 280                 285

Ser Val Ser Thr Ala Ala Gly Thr Pro Val Val Val Thr Arg Thr Ser
    290                 295                 300

Glu Thr Ala Pro Tyr Thr Gly Ala Met Thr Pro Thr Val Ala Ala Arg
305                 310                 315                 320

Met Lys Gly Arg Gly Tyr Asp Arg Arg Gly
                325                 330


<210> SEQ ID NO 28
<211> LENGTH: 236
<212> TYPE: PRT
<213> ORGANISM: Thielavia terrestris

<400> SEQUENCE: 28

Met Lys Thr Phe Thr Ala Leu Leu Ala Ala Ala Gly Leu Val Ala Gly
1               5                   10                  15

His Gly Tyr Val Asp Asn Ala Thr Ile Gly Gly Gln Phe Tyr Gln Asn
            20                  25                  30

Pro Ala Val Leu Thr Phe Phe Gln Pro Asp Arg Val Ser Arg Ser Ile
        35                  40                  45

Pro Gly Asn Gly Pro Val Thr Asp Val Thr Leu Ile Asp Leu Gln Cys
    50                  55                  60

Asn Ala Asn Ser Thr Pro Ala Lys Leu His Ala Thr Ala Ala Ala Gly
65                  70                  75                  80

Ser Asp Val Ile Leu Arg Trp Thr Leu Trp Pro Glu Ser His Val Gly
                85                  90                  95

Pro Val Ile Thr Tyr Met Ala Arg Cys Pro Asp Thr Gly Cys Gln Asp
            100                 105                 110

Trp Met Pro Gly Thr Ser Ala Val Trp Phe Lys Ile Lys Glu Gly Gly
        115                 120                 125

Arg Asp Gly Thr Ser Asn Thr Trp Ala Asp Thr Pro Leu Met Thr Ala
    130                 135                 140

Pro Thr Ser Tyr Thr Tyr Thr Ile Pro Ser Cys Leu Lys Lys Gly Tyr
145                 150                 155                 160

Tyr Leu Val Arg His Glu Ile Ile Ala Leu His Ala Ala Tyr Thr Tyr
```

```
                165                 170                 175

Pro Gly Ala Gln Phe Tyr Pro Gly Cys His Gln Leu Asn Val Thr Gly
            180                 185                 190

Gly Gly Ser Thr Val Pro Ser Ser Gly Leu Val Ala Phe Pro Gly Ala
        195                 200                 205

Tyr Lys Gly Ser Asp Pro Gly Ile Thr Tyr Asp Ala Tyr Lys Ala Gln
    210                 215                 220

Thr Tyr Gln Ile Pro Gly Pro Ala Val Phe Thr Cys
225                 230                 235


<210> SEQ ID NO 29
<211> LENGTH: 250
<212> TYPE: PRT
<213> ORGANISM: Thielavia terrestris

<400> SEQUENCE: 29

Met Ala Leu Leu Leu Leu Ala Gly Leu Ala Ile Leu Ala Gly Pro Ala
1               5                   10                  15

His Ala His Gly Gly Leu Ala Asn Tyr Thr Val Gly Asn Thr Trp Tyr
            20                  25                  30

Arg Gly Tyr Asp Pro Phe Thr Pro Ala Ala Asp Gln Ile Gly Gln Pro
        35                  40                  45

Trp Met Ile Gln Arg Ala Trp Asp Ser Ile Asp Pro Ile Phe Ser Val
    50                  55                  60

Asn Asp Lys Ala Leu Ala Cys Asn Thr Pro Ala Thr Ala Pro Thr Ser
65                  70                  75                  80

Tyr Ile Pro Ile Arg Ala Gly Glu Asn Ile Thr Ala Val Tyr Trp Tyr
                85                  90                  95

Trp Leu His Pro Val Gly Pro Met Thr Ala Trp Leu Ala Arg Cys Asp
            100                 105                 110

Gly Asp Cys Arg Asp Ala Asp Val Asn Glu Ala Arg Trp Phe Lys Ile
        115                 120                 125

Trp Glu Ala Gly Leu Leu Ser Gly Pro Asn Leu Ala Glu Gly Met Trp
    130                 135                 140

Tyr Gln Lys Ala Phe Gln Asn Trp Asp Gly Ser Pro Asp Leu Trp Pro
145                 150                 155                 160

Val Thr Ile Pro Ala Gly Leu Lys Ser Gly Leu Tyr Met Ile Arg His
                165                 170                 175

Glu Ile Leu Ser Ile His Val Glu Asp Lys Pro Gln Phe Tyr Pro Glu
            180                 185                 190

Cys Ala His Leu Asn Val Thr Gly Gly Gly Asp Leu Leu Pro Pro Asp
        195                 200                 205

Glu Phe Leu Val Lys Phe Pro Gly Ala Tyr Lys Glu Asp Asn Pro Ser
    210                 215                 220

Ile Lys Ile Asn Ile Tyr Ser Asp Gln Tyr Ala Asn Thr Thr Asn Tyr
225                 230                 235                 240

Thr Ile Pro Gly Gly Pro Ile Trp Asp Gly
                245                 250


<210> SEQ ID NO 30
<211> LENGTH: 478
<212> TYPE: PRT
<213> ORGANISM: Thielavia terrestris

<400> SEQUENCE: 30

Met Met Pro Ser Leu Val Arg Phe Ser Met Gly Leu Ala Thr Ala Phe
```

```
1               5                   10                  15

Ala Ser Leu Ser Thr Ala His Thr Val Phe Thr Thr Leu Phe Ile Asn
            20                  25                  30

Gly Val Asp Gln Gly Asp Gly Thr Cys Ile Arg Met Ala Lys Lys Gly
        35                  40                  45

Ser Val Cys Thr His Pro Ile Ala Gly Gly Leu Asp Ser Pro Asp Met
    50                  55                  60

Ala Cys Gly Arg Asp Gly Gln Gln Ala Val Ala Phe Thr Cys Pro Ala
65                  70                  75                  80

Pro Ala Gly Ser Lys Leu Ser Phe Glu Phe Arg Met Trp Ala Asp Ala
                85                  90                  95

Ser Gln Pro Gly Ser Ile Asp Pro Ser His Leu Gly Ser Thr Ala Ile
            100                 105                 110

Tyr Leu Lys Gln Val Ser Asn Ile Ser Ser Asp Ser Ala Ala Gly Pro
        115                 120                 125

Gly Trp Phe Lys Ile Tyr Ala Glu Gly Tyr Asp Thr Ala Ala Lys Lys
    130                 135                 140

Trp Ala Thr Glu Lys Leu Ile Asp Asn Gly Gly Leu Leu Ser Ile Glu
145                 150                 155                 160

Leu Pro Pro Thr Leu Pro Ala Gly Tyr Tyr Leu Ala Arg Ser Glu Ile
                165                 170                 175

Val Thr Ile Gln Asn Val Thr Asn Asp His Val Asp Pro Gln Phe Tyr
            180                 185                 190

Val Gly Cys Ala Gln Leu Phe Val Gln Gly Pro Pro Thr Thr Pro Thr
        195                 200                 205

Val Pro Pro Asp Arg Leu Val Ser Ile Pro Gly His Val His Ala Ser
    210                 215                 220

Asp Pro Gly Leu Thr Phe Asn Ile Trp Arg Asp Asp Pro Ser Lys Thr
225                 230                 235                 240

Ala Tyr Thr Val Val Gly Pro Ala Pro Phe Ser Pro Thr Ala Ala Pro
                245                 250                 255

Thr Pro Thr Ser Thr Asn Thr Asn Gly Gln Gln Gln Gln Gln Gln Gln
            260                 265                 270

Gln Ala Ile Lys Gln Thr Asp Gly Val Ile Pro Ala Asp Cys Gln Leu
        275                 280                 285

Lys Asn Ala Asn Trp Cys Gly Ala Glu Val Pro Ala Tyr Ala Asp Glu
    290                 295                 300

Ala Gly Cys Trp Ala Ser Ser Ala Asp Cys Phe Ala Gln Leu Asp Ala
305                 310                 315                 320

Cys Tyr Thr Ser Ala Pro Pro Thr Gly Ser Arg Gly Cys Arg Leu Trp
                325                 330                 335

Glu Asp Trp Cys Thr Gly Ile Gln Gln Gly Cys Arg Ala Gly Arg Trp
            340                 345                 350

Arg Gly Pro Pro Pro Phe His Gly Glu Gly Ala Ala Ala Glu Thr Ala
        355                 360                 365

Ser Ala Gly Arg Gly Gly Ala Arg Ile Ala Ala Val Ala Gly Cys Gly
    370                 375                 380

Gly Gly Thr Gly Asp Met Val Glu Glu Val Phe Leu Phe Tyr Trp Asp
385                 390                 395                 400

Ala Cys Ser Gly Trp Arg Arg Ser Arg Gly Gly Gly Ser Ile Leu Ala
                405                 410                 415

Arg Leu Ile Leu His Val Leu Leu Pro Leu Leu Arg Pro Arg Arg Ala
            420                 425                 430
```

```
Pro Arg Val His Leu Leu Leu Phe His Leu Tyr Leu Asn Phe Cys Tyr
        435                 440                 445

Pro Gly Thr Ser Gly Phe Tyr Asn Arg Leu Ser Ile Lys Leu Gly Ile
    450                 455                 460

Trp Pro Ser Lys Met Ser Pro Asp Val Ala His Tyr Val Lys
465                 470                 475


<210> SEQ ID NO 31
<211> LENGTH: 230
<212> TYPE: PRT
<213> ORGANISM: Thielavia terrestris

<400> SEQUENCE: 31

Met Gln Leu Leu Val Gly Leu Leu Leu Ala Ala Val Ala Ala Arg Ala
1               5                   10                  15

His Tyr Thr Phe Pro Arg Leu Val Val Asn Gly Gln Pro Glu Asp Lys
            20                  25                  30

Asp Trp Ser Val Thr Arg Met Thr Lys Asn Ala Gln Ser Lys Gln Gly
        35                  40                  45

Val Gln Asp Pro Thr Ser Pro Asp Ile Arg Cys Tyr Thr Ser Gln Thr
    50                  55                  60

Ala Pro Asn Val Ala Thr Val Pro Ala Gly Ala Thr Val His Tyr Ile
65                  70                  75                  80

Ser Thr Gln Gln Ile Asn His Pro Gly Pro Thr Gln Tyr Tyr Leu Ala
                85                  90                  95

Lys Val Pro Ala Gly Ser Ser Ala Lys Thr Trp Asp Gly Ser Gly Ala
            100                 105                 110

Val Trp Phe Lys Ile Ser Thr Thr Met Pro Tyr Leu Asp Asn Asn Lys
        115                 120                 125

Gln Leu Val Trp Pro Asn Gln Asn Thr Tyr Thr Thr Val Asn Thr Thr
    130                 135                 140

Ile Pro Ala Asp Thr Pro Ser Gly Glu Tyr Leu Leu Arg Val Glu Gln
145                 150                 155                 160

Ile Ala Leu His Leu Ala Ser Gln Pro Asn Gly Ala Gln Phe Tyr Leu
                165                 170                 175

Ala Cys Ser Gln Ile Gln Ile Thr Gly Gly Gly Asn Gly Thr Pro Gly
            180                 185                 190

Pro Leu Val Ala Leu Pro Gly Ala Tyr Lys Ser Asn Asp Pro Gly Ile
        195                 200                 205

Leu Val Asn Ile Tyr Ser Met Gln Pro Gly Asp Tyr Lys Pro Pro Gly
    210                 215                 220

Pro Pro Val Trp Ser Gly
225                 230


<210> SEQ ID NO 32
<211> LENGTH: 257
<212> TYPE: PRT
<213> ORGANISM: Thielavia terrestris

<400> SEQUENCE: 32

Met Lys Leu Tyr Leu Ala Ala Phe Leu Gly Ala Val Ala Thr Pro Gly
1               5                   10                  15

Ala Phe Ala His Gln Ile His Gly Ile Leu Leu Val Asn Gly Thr Glu
            20                  25                  30

Thr Pro Glu Trp Lys Tyr Val Arg Asp Val Ala Trp Glu Gly Ala Tyr
        35                  40                  45
```

```
Glu Pro Glu Lys Tyr Pro Asn Thr Glu Phe Phe Lys Thr Pro Pro Gln
    50                  55                  60

Thr Asp Ile Asn Asn Pro Asn Ile Thr Cys Gly Arg Asn Ala Phe Asp
65                  70                  75                  80

Ser Ala Ser Lys Thr Glu Thr Ala Asp Ile Leu Ala Gly Ser Glu Val
                85                  90                  95

Gly Phe Arg Val Ser Trp Asp Gly Asn Gly Lys Tyr Gly Val Phe Trp
            100                 105                 110

His Pro Gly Pro Gly Gln Ile Tyr Leu Ser Arg Ala Pro Asn Asp Asp
        115                 120                 125

Leu Glu Asp Tyr Arg Gly Asp Gly Asp Trp Phe Lys Ile Ala Thr Gly
    130                 135                 140

Ala Ala Val Ser Asn Thr Glu Trp Leu Leu Trp Asn Lys His Asp Phe
145                 150                 155                 160

Asn Phe Thr Ile Pro Lys Thr Thr Pro Pro Gly Lys Tyr Leu Met Arg
                165                 170                 175

Ile Glu Gln Phe Met Pro Ser Thr Val Glu Tyr Ser Gln Trp Tyr Val
            180                 185                 190

Asn Cys Ala His Val Asn Ile Ile Gly Pro Gly Gly Gly Thr Pro Thr
        195                 200                 205

Gly Phe Ala Arg Phe Pro Gly Thr Tyr Thr Val Asp Asp Pro Gly Ile
    210                 215                 220

Lys Val Pro Leu Asn Gln Ile Val Asn Ser Gly Glu Leu Pro Gln Asp
225                 230                 235                 240

Gln Leu Arg Leu Leu Glu Tyr Lys Pro Pro Gly Pro Ala Leu Trp Thr
                245                 250                 255

Gly


<210> SEQ ID NO 33
<211> LENGTH: 251
<212> TYPE: PRT
<213> ORGANISM: Thermoascus crustaceus

<400> SEQUENCE: 33

Met Ala Phe Ser Gln Ile Met Ala Ile Thr Gly Val Phe Leu Ala Ser
1               5                   10                  15

Ala Ser Leu Val Ala Gly His Gly Phe Val Gln Asn Ile Val Ile Asp
            20                  25                  30

Gly Lys Ser Tyr Gly Gly Tyr Ile Val Asn Gln Tyr Pro Tyr Met Ser
        35                  40                  45

Asp Pro Pro Glu Val Val Gly Trp Ser Thr Thr Ala Thr Asp Leu Gly
    50                  55                  60

Phe Val Asp Gly Thr Gly Tyr Gln Gly Pro Asp Ile Ile Cys His Arg
65                  70                  75                  80

Gly Ala Lys Pro Ala Ala Leu Thr Ala Gln Val Ala Ala Gly Gly Thr
                85                  90                  95

Val Lys Leu Glu Trp Thr Pro Trp Pro Asp Ser His His Gly Pro Val
            100                 105                 110

Ile Asn Tyr Leu Ala Pro Cys Asn Gly Asp Cys Ser Thr Val Asp Lys
        115                 120                 125

Thr Gln Leu Lys Phe Phe Lys Ile Ala Gln Ala Gly Leu Ile Asp Asp
    130                 135                 140

Asn Ser Pro Pro Gly Ile Trp Ala Ser Asp Asn Leu Ile Ala Ala Asn
145                 150                 155                 160
```

```
Asn Ser Trp Thr Val Thr Ile Pro Thr Thr Thr Ala Pro Gly Asn Tyr
                165                 170                 175

Val Leu Arg His Glu Ile Ile Ala Leu His Ser Ala Gly Asn Lys Asp
            180                 185                 190

Gly Ala Gln Asn Tyr Pro Gln Cys Ile Asn Leu Lys Val Thr Gly Asn
        195                 200                 205

Gly Ser Gly Asn Pro Pro Ala Gly Ala Leu Gly Thr Ala Leu Tyr Lys
    210                 215                 220

Asp Thr Asp Pro Gly Ile Leu Ile Asn Ile Tyr Gln Lys Leu Ser Ser
225                 230                 235                 240

Tyr Val Ile Pro Gly Pro Ala Leu Tyr Thr Gly
                245                 250


<210> SEQ ID NO 34
<211> LENGTH: 349
<212> TYPE: PRT
<213> ORGANISM: Thermoascus crustaceus

<400> SEQUENCE: 34

Met Ser Phe Ser Lys Ile Leu Ala Ile Ala Gly Ala Ile Thr Tyr Ala
1               5                   10                  15

Ser Ser Ala Ala Ala His Gly Tyr Val Gln Gly Ile Val Val Asp Gly
            20                  25                  30

Ser Tyr Tyr Gly Gly Tyr Met Val Thr Gln Tyr Pro Tyr Thr Ala Gln
        35                  40                  45

Pro Pro Glu Leu Ile Ala Trp Ser Thr Lys Ala Thr Asp Leu Gly Phe
    50                  55                  60

Val Asp Gly Ser Gly Tyr Thr Ser Pro Asp Ile Ile Cys His Lys Gly
65                  70                  75                  80

Ala Glu Pro Gly Ala Gln Ser Ala Lys Val Ala Ala Gly Gly Thr Val
                85                  90                  95

Glu Leu Gln Trp Thr Ala Trp Pro Glu Ser His Lys Gly Pro Val Ile
            100                 105                 110

Asp Tyr Leu Ala Ala Cys Asp Gly Asp Cys Ser Ser Val Asp Lys Thr
        115                 120                 125

Ala Leu Lys Phe Phe Lys Ile Asp Glu Ser Gly Leu Ile Asp Gly Asn
    130                 135                 140

Gly Ala Gly Thr Trp Ala Ser Asp Thr Leu Ile Lys Asn Asn Asn Ser
145                 150                 155                 160

Trp Thr Val Thr Ile Pro Ser Thr Ile Ala Ser Gly Asn Tyr Val Leu
                165                 170                 175

Arg His Glu Ile Ile Ala Leu His Ser Ala Gly Asn Lys Asp Gly Ala
            180                 185                 190

Gln Asn Tyr Pro Gln Cys Ile Asn Leu Glu Val Thr Gly Ser Gly Thr
        195                 200                 205

Glu Asn Pro Ala Gly Thr Leu Gly Thr Ala Leu Tyr Thr Asp Thr Asp
    210                 215                 220

Pro Gly Leu Leu Val Asn Ile Tyr Gln Gly Leu Ser Asn Tyr Ser Ile
225                 230                 235                 240

Pro Gly Pro Ala Leu Tyr Ser Gly Asn Ser Asp Asn Ala Gly Ser Leu
                245                 250                 255

Asn Pro Thr Thr Thr Pro Ser Ile Gln Asn Ala Ala Ala Ala Pro Ser
            260                 265                 270

Thr Ser Thr Ala Ser Val Val Thr Asp Ser Ser Ser Ala Thr Gln Thr
```

```
        275                 280                 285

Ala Ser Val Ala Ala Thr Thr Pro Ala Ser Thr Ser Ala Val Thr Ala
    290                 295                 300

Ser Pro Ala Pro Asp Thr Gly Ser Asp Val Thr Lys Tyr Leu Asp Ser
305                 310                 315                 320

Met Ser Ser Asp Glu Val Leu Thr Leu Val Arg Gly Thr Leu Ser Trp
                325                 330                 335

Leu Val Ser Asn Lys Lys His Ala Arg Asp Leu Ser His
            340                 345


<210> SEQ ID NO 35
<211> LENGTH: 436
<212> TYPE: PRT
<213> ORGANISM: Thermoascus crustaceus

<400> SEQUENCE: 35

Met Leu Ser Phe Ile Pro Thr Lys Ser Ala Ala Leu Thr Thr Leu Leu
1               5                   10                  15

Leu Leu Gly Thr Ala His Ala His Thr Leu Met Thr Thr Met Phe Val
            20                  25                  30

Asp Gly Val Asn Gln Gly Asp Gly Val Cys Ile Arg Met Asn Asn Asp
        35                  40                  45

Gly Gly Thr Ala Asn Thr Tyr Ile Gln Pro Ile Thr Ser Lys Asp Ile
    50                  55                  60

Ala Cys Gly Ile Gln Gly Glu Ile Gly Ala Ser Arg Val Cys Pro Val
65                  70                  75                  80

Lys Ala Ser Ser Thr Leu Thr Phe Gln Phe Arg Glu Gln Pro Asn Asn
                85                  90                  95

Pro Asn Ser Ser Pro Leu Asp Pro Ser His Lys Gly Pro Ala Ala Val
            100                 105                 110

Tyr Leu Lys Lys Val Asp Ser Ala Ile Ala Ser Asn Asn Ala Ala Gly
        115                 120                 125

Asp Ser Trp Phe Lys Ile Trp Glu Ser Val Tyr Asp Glu Ser Thr Gly
    130                 135                 140

Lys Trp Gly Thr Thr Lys Met Ile Glu Asn Asn Gly His Ile Ser Val
145                 150                 155                 160

Lys Val Pro Asp Asp Ile Glu Gly Gly Tyr Tyr Leu Ala Arg Thr Glu
                165                 170                 175

Leu Leu Ala Leu His Ser Ala Asp Gln Gly Asp Pro Gln Phe Tyr Val
            180                 185                 190

Gly Cys Ala Gln Leu Phe Ile Asp Ser Asp Gly Thr Ala Lys Pro Pro
        195                 200                 205

Thr Val Ser Ile Gly Glu Gly Thr Tyr Asp Leu Ser Met Pro Ala Met
    210                 215                 220

Thr Tyr Asn Ile Trp Glu Thr Pro Leu Ala Leu Pro Tyr Pro Met Tyr
225                 230                 235                 240

Gly Pro Pro Val Tyr Thr Pro Gly Ser Gly Ser Gly Ser Val Arg Ala
                245                 250                 255

Thr Ser Ser Ser Ala Val Pro Thr Ala Thr Glu Ser Ser Phe Val Glu
            260                 265                 270

Glu Arg Ala Asn Pro Val Thr Ala Asn Ser Val Tyr Ser Ala Arg Gly
        275                 280                 285

Lys Phe Lys Thr Trp Ile Asp Lys Leu Ser Trp Arg Gly Lys Val Arg
    290                 295                 300
```

```
Glu Asn Val Arg Gln Ala Ala Gly Arg Arg Ser Thr Leu Val Gln Thr
305                 310                 315                 320

Val Gly Leu Lys Pro Lys Gly Cys Ile Phe Val Asn Gly Asn Trp Cys
                325                 330                 335

Gly Phe Glu Val Pro Asp Tyr Asn Asp Ala Glu Ser Cys Trp Ala Ala
            340                 345                 350

Ser Asp Asn Cys Trp Lys Gln Ser Asp Ala Cys Trp Asn Lys Thr Gln
        355                 360                 365

Pro Thr Gly Tyr Asn Asn Cys Gln Ile Trp Gln Asp Lys Lys Cys Lys
    370                 375                 380

Val Ile Gln Asp Ser Cys Ser Gly Pro Asn Pro His Gly Pro Pro Asn
385                 390                 395                 400

Lys Gly Lys Asp Leu Thr Pro Glu Trp Pro Pro Leu Lys Gly Ser Met
                405                 410                 415

Asp Thr Phe Ser Lys Arg Thr Ile Gly Tyr Arg Asp Trp Ile Val Arg
            420                 425                 430

Arg Arg Gly Ala
        435


<210> SEQ ID NO 36
<211> LENGTH: 278
<212> TYPE: PRT
<213> ORGANISM: Artificial
<220> FEATURE:
<223> OTHER INFORMATION: Q120H variant of the mature endoglucanase shown
      as SEQ ID NO: 9 of WO 96/29397

<400> SEQUENCE: 36

Ala Ser Gly Ser Gly Gln Ser Thr Arg Tyr Trp Asp Cys Cys Lys Pro
1               5                   10                  15

Ser Cys Ala Trp Pro Gly Lys Ala Ala Val Ser Gln Pro Val Tyr Ala
            20                  25                  30

Cys Asp Ala Asn Phe Gln Arg Leu Ser Asp Phe Asn Val Gln Ser Gly
        35                  40                  45

Cys Asn Gly Gly Ser Ala Tyr Ser Cys Ala Asp Gln Thr Pro Trp Ala
    50                  55                  60

Val Asn Asp Asn Leu Ala Tyr Gly Phe Ala Ala Thr Ser Ile Ala Gly
65                  70                  75                  80

Gly Ser Glu Ser Ser Trp Cys Cys Ala Cys Tyr Ala Leu Thr Phe Thr
                85                  90                  95

Ser Gly Pro Val Ala Gly Lys Thr Met Val Val Gln Ser Thr Ser Thr
            100                 105                 110

Gly Gly Asp Leu Gly Ser Asn His Phe Asp Ile Ala Met Pro Gly Gly
        115                 120                 125

Gly Val Gly Ile Phe Asn Gly Cys Ser Ser Gln Phe Gly Gly Leu Pro
    130                 135                 140

Gly Ala Gln Tyr Gly Gly Ile Ser Ser Arg Asp Gln Cys Asp Ser Phe
145                 150                 155                 160

Pro Ala Pro Leu Lys Pro Gly Cys Gln Trp Arg Phe Asp Trp Phe Gln
                165                 170                 175

Asn Ala Asp Asn Pro Thr Phe Thr Phe Gln Gln Val Gln Cys Pro Ala
            180                 185                 190

Glu Ile Val Ala Arg Ser Gly Cys Lys Arg Asn Asp Asp Ser Ser Phe
        195                 200                 205

Pro Val Phe Thr Pro Pro Ser Gly Gly Asn Gly Gly Thr Gly Thr Pro
    210                 215                 220
```

-continued

```
Thr Ser Thr Ala Pro Gly Ser Gly Gln Thr Ser Pro Gly Gly Gly Ser
225                 230                 235                 240

Gly Cys Thr Ser Gln Lys Trp Ala Gln Cys Gly Gly Ile Gly Phe Ser
                245                 250                 255

Gly Cys Thr Thr Cys Val Ser Gly Thr Thr Cys Gln Lys Leu Asn Asp
            260                 265                 270

Tyr Tyr Ser Gln Cys Leu
        275
```

The invention claimed is:

1. A method for increasing the short span compression strength of a paper or packaging material made from a pulp, comprising treating the pulp with a glycoside hydrolase Family 61 in an amount sufficient to increase the short span compression strength of a paper or packaging material made from a pulp, wherein the amino acid sequence of the glycoside hydrolase Family 61 comprises one or more of the following motifs:

[ILMV]-P-x(4,5)-G-x-Y-[ILMV]-x-R-x-[EQ]-x(4)-[HNQ],

H-x(1,2)-G-P-x(3)-[YW]-[AILMV], and

[EQ]-x-Y-x(2)-C-x-[EHQN]-[FILV]-x-[ILV], in which x is any amino acid, x(4,5) is any four or five contiguous amino acids, x(4) is any four contiguous amino acids, x(1,2) is any one or two contiguous amino acids, x(3) is any three contiguous amino acids, and x(2) is any two contiguous amino acids, and wherein the glycoside hydrolase Family 61 comprises or consists of an amino acid sequence having least 90% sequence identity to the mature polypeptide of SEQ ID NO: 1, SEQ ID NO: 2, or SEQ ID NO: 3, and wherein the pulp is also treated with an endoglucanase having at least 90% sequence identity with SEQ ID NO: 36.

2. The method of claim 1, further comprising making a paper or packaging material from the treated pulp.

3. The method of claim 1, wherein the glycoside hydrolase Family 61 comprises an amino acid sequence having at least 95% sequence identity to the amino acid sequence of SEQ ID NO: 1, SEQ ID NO: 2, or SEQ ID NO: 3.

4. The method of claim 1, wherein the glycoside hydrolase Family 61 comprises or consists of an amino acid sequence having up to 10 substitution(s) as compared to the mature polypeptide of SEQ ID NO: 1, SEQ ID NO: 2, or SEQ ID NO: 3.

5. The method of claim 1, wherein the glycoside hydrolase Family 61 comprises or consists of the mature polypeptide of SEQ ID NO: 1, SEQ ID NO: 2, or SEQ ID NO: 3.

6. The method of claim 1, wherein the pulp is a recovered, recycled or secondary pulp.

7. The method of claim 1, wherein the pulp is Kraft pulp or sulphite pulp.

8. The method of claim 1, wherein the pulp is wood pulp, hardwood pulp, eucalyptus pulp, softwood pulp, or pine pulp.

9. The method of claim 1, wherein the pulp is dewatered compared to pulp from a similar process without the glycoside hydrolase Family 61.

10. The method of claim 1, wherein the pulp is treated with about 0.1 to about 100,000 mg of the glycoside hydrolase Family 61 per ton of pulp.

11. The method of claim 1, wherein the pulp is treated with the glycoside hydrolase Family 61 for about 1 minute to about 5 hours.

12. The method of claim 1, wherein the pulp is treated with the glycoside hydrolase Family 61 for about 10 minutes to about 3 hours.

13. The method of claim 1, wherein the pulp is treated with the glycoside hydrolase Family 61 for about 15 minutes to about 2 hours.

14. The method of claim 1, wherein the pulp is treated with the glycoside hydrolase Family 61 for about 15 minutes to about 1 hour.

* * * * *